US011137716B2

(12) United States Patent
Hiyama et al.

(10) Patent No.: US 11,137,716 B2
(45) Date of Patent: Oct. 5, 2021

(54) PROCESS CARTRIDGE AND ELECTROPHOTOGRAPHIC APPARATUS

(71) Applicant: CANON KABUSHIKI KAISHA, Tokyo (JP)

(72) Inventors: Fumiyuki Hiyama, Suntou-gun (JP); Kaname Watariguchi, Yokohama (JP); Kohei Makisumi, Suntou-gun (JP); Kazuhiro Yamauchi, Suntou-gun (JP); Yuichi Kikuchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/070,085

(22) Filed: Oct. 14, 2020

(65) Prior Publication Data

US 2021/0116857 A1 Apr. 22, 2021

(30) Foreign Application Priority Data

Oct. 18, 2019 (JP) ..... JP2019-191564

(51) Int. Cl.
*G03G 21/18* (2006.01)
*G03G 5/05* (2006.01)
(Continued)

(52) U.S. Cl.
CPC ..... *G03G 21/1814* (2013.01); *G03G 5/00* (2013.01); *G03G 5/0553* (2013.01);
(Continued)

(58) Field of Classification Search
CPC ..... G03G 15/0233
See application file for complete search history.

(56) References Cited

U.S. PATENT DOCUMENTS 5,809,379 A 9/1998 Yano et al.
6,697,587 B2 2/2004 Harada
(Continued)

FOREIGN PATENT DOCUMENTS

JP 06-51594 A 2/1994
JP 2002-003651 A 1/2002
(Continued)

OTHER PUBLICATIONS

U.S. Appl. No. 17/065,258, Kohei Makisumi, filed Oct. 7, 2020.
(Continued)

*Primary Examiner* — Clayton E. LaBalle
*Assistant Examiner* — Leon W Rhodes, Jr.
(74) *Attorney, Agent, or Firm* — Venable LLP

(57) ABSTRACT

There is provided a process cartridge detachably attachable to a main body of an electrophotographic apparatus, the process cartridge including: an electrophotographic photosensitive member and a charging member, in which when average local potential differences of calculated lengths in the electrophotographic photosensitive member is calculated based on a specific method, a maximum value of the average local potential difference is 2 V or more, the charging member includes a support and an electro-conductive layer, the electro-conductive layer has a matrix and domains dispersed in the matrix, a volume resistivity ρM of the matrix is at least $1.00\times10^5$ times a volume resistivity ρD of the domain, and a specific calculated length $S_{CP}$ [μm] and a specific value relating a distance between the domains $D_{ms}$ [μm] satisfy $S_{CP}\geq3\times D_{ms}$.

11 Claims, 5 Drawing Sheets

(51) Int. Cl.
*G03G 15/02* (2006.01)
*G03G 5/00* (2006.01)
*G03G 15/16* (2006.01)

(52) U.S. Cl.
CPC ..... *G03G 5/0596* (2013.01); *G03G 15/0233* (2013.01); *G03G 15/1685* (2013.01); *G03G 2215/00071* (2013.01)

(56) References Cited

U.S. PATENT DOCUMENTS

| | | | |
|---|---|---|---|
| 6,951,688 | B2 | 10/2005 | Kato et al. |
| 8,298,670 | B2 | 10/2012 | Muranaka et al. |
| 8,449,975 | B2 | 5/2013 | Hirakoso et al. |
| 8,491,994 | B2 | 7/2013 | Harada et al. |
| 8,628,854 | B2 | 1/2014 | Yamauchi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,841,052 | B2 | 9/2014 | Watariguchi et al. |
| 8,852,743 | B2 | 10/2014 | Kikuchi et al. |
| 8,974,991 | B2 | 3/2015 | Kawahara et al. |
| 9,023,465 | B2 | 5/2015 | Yamada et al. |
| 9,068,083 | B2 | 6/2015 | Tanaka et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,436,106 | B2 | 9/2016 | Kuno et al. |
| 9,442,408 | B2 | 9/2016 | Yamauchi et al. |
| 9,442,451 | B2 | 9/2016 | Yamauchi et al. |
| 9,459,542 | B2 | 10/2016 | Tanaka et al. |
| 9,500,966 | B2 | 11/2016 | Watariguchi et al. |
| 9,535,347 | B2 | 1/2017 | Watariguchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,563,139 | B2 | 2/2017 | Kawahara et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,645,515 | B2 | 5/2017 | Kuno et al. |
| 9,645,516 | B2 | 5/2017 | Kawahara et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,869,032 | B2 | 1/2018 | Kawahara et al. |
| 9,897,931 | B2 | 2/2018 | Nishioka et al. |
| 9,904,234 | B2 | 2/2018 | Kudoh |
| 9,958,802 | B2 | 5/2018 | Kikuchi et al. |
| 9,964,914 | B2 | 5/2018 | Arimura et al. |
| 9,977,353 | B2 | 5/2018 | Nishioka et al. |
| 10,012,924 | B2 | 7/2018 | Yoshidome et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 2012/0308261 | A1 | 12/2012 | Tsuru et al. |
| 2013/0281276 | A1 | 10/2013 | Watanabe et al. |
| 2014/0141362 | A1 | 5/2014 | Watariguchi et al. |
| 2015/0093693 | A1 | 4/2015 | Watariguchi et al. |
| 2015/0331346 | A1 | 11/2015 | Yamauchi et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2020/0159137 | A1 | 5/2020 | Ito et al. |
| 2020/0174385 | A1 | 6/2020 | Sakakibara et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2020/0393771 | A1 | 12/2020 | Iwasaki et al. |
| 2020/0409278 | A1 | 12/2020 | Makisumi et al. |
| 2020/0409279 | A1 | 12/2020 | Sekiya et al. |
| 2020/0409280 | A1 | 12/2020 | Ishida et al. |
| 2020/0409281 | A1 | 12/2020 | Watariguchi et al. |
| 2021/0026295 | A1 | 1/2021 | Yamada et al. |
| 2021/0033996 | A1 | 2/2021 | Kikuchi et al. |
| 2021/0041796 | A1 | 2/2021 | Nishioka et al. |

FOREIGN PATENT DOCUMENTS

| | | | |
|---|---|---|---|
| JP | 2004-151695 | A | 5/2004 |
| JP | 2006-184426 | A | 7/2006 |
| JP | 2009-031499 | A | 2/2009 |
| JP | 2012-163954 | A | 8/2012 |
| JP | 2013-117624 | A | 6/2013 |
| JP | 2016-188931 | A | 11/2016 |
| JP | 2017-072833 | A | 4/2017 |

OTHER PUBLICATIONS

U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,179, Kaname Watariguchi, filed Oct. 14, 2020.
U.S. Appl. No. 17/071,103, Noriyoshi Umeda, filed Oct. 15, 2020.
U.S. Appl. No. 17/071,109, Shohei Kototani, filed Oct. 15, 2020.
U.S. Appl. No. 17/071,227, Kosuke Fukudome, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.
Paul G. Roetling, "Visual Performance and Image Coding", SPIE/OSA, 1976, vol. 74, pp. 195-199.

PROCESS CARTRIDGE AND ELECTROPHOTOGRAPHIC APPARATUS

BACKGROUND OF THE INVENTION

Field of the Invention

The present disclosure relates to a process cartridge including an electrophotographic photosensitive member and a charging member, and an electrophotographic apparatus.

Description of the Related Art

In an electrophotographic process relating to an electrophotographic photosensitive member (hereinafter, also simply referred to as a photosensitive member), four processes of charging, exposing, developing, and transferring are mainly included, and, if necessary, a process of cleaning or pre-exposing is additionally included. Recently, an electrophotographic process of a reversal development system is generally applied to an electrophotographic apparatus corresponding to digitization. In the case of the reversal development system, a polarity of a photosensitive member in charging is opposite to a polarity of the photosensitive member in transfer. Therefore, chargeability varies depending on a transfer condition and a so-called transfer memory occurs, and thus, density unevenness on an image is likely to occur. Accordingly, in the related art, in order to remove the transfer memory occurred, a method for removing a transfer memory by adding a pre-exposing process or an antistatic process before a charging process, or a measure for controlling a transfer bias and thus suppressing an occurrence of a transfer memory in a transfer process has been proposed.

However, recently, in accordance with a demand for miniaturization and a cost reduction, it has been required to simplify or remove the pre-exposing process, the antistatic process, and the control of the transfer bias.

Meanwhile, in the related art, a corona type or roller type charging member has been mainly used as a charging member imparting charges to the photosensitive member in the charging process. Among them, in the case of the corona type charging member, an applied voltage is higher than that in the roller type charging member. Accordingly, the corona type charging member is disadvantageous in terms of a size and a cost of a required power supply. Furthermore, the corona type charging member generates a large amount of ozone, which causes an environmental problem.

On the other hand, in the case of the roller type charging member, an applied voltage is low, a size and a cost of a power supply are reduced, and the amount of ozone generated is also small, which is excellent in terms of an environment. In addition, examples of a type of the roller type charging member include an alternating current (AC)/direct current (DC) charging type and a DC charging type. In a case of the DC charging type, the size and the cost of the power supply can be further reduced as compared with the AC/DC charging type. However, in the case of the DC charging type, charging capability or charging uniformity is deteriorated, and ability to remove the transfer memory in the charging process is poor.

Japanese Patent Application Laid-Open No. H06-51594 discloses an electrophotographic photosensitive member including a photosensitive layer having photo-electro-conductivity and a rectifying layer forming an energy barrier at an interface with the photosensitive layer. In the configuration disclosed in Japanese Patent Application Laid-Open No. H06-51594, intrusion of charges having polarities opposite to a charging polarity that occurs in the transfer process is prevented, and the transfer memory can thus be suppressed. Therefore, it is possible to simplify the control of the transfer bias.

Japanese Patent Application Laid-Open No. 2009-31499 discloses an electrophotographic photosensitive member including a surface layer having a surface on which unevenness is formed. In the configuration disclosed in Japanese Patent Application Laid-Open No. 2009-31499, the surface of the surface layer is formed in a specific shape, such that discharge in the transfer process can be controlled, and the occurrence of the transfer memory can thus be suppressed.

Japanese Patent Application Laid-Open No. 2016-188931 discloses a step of applying an AC voltage of 2 kHz or more before a charging process and controlling a frequency of the AC voltage according to use history to suppress transfer memory.

Japanese Patent Application Laid-Open No. 2002-003651 discloses a charging member including a rubber composition and an elastic layer formed of the rubber composition, the rubber composition having a matrix-domain structure including a polymer continuous phase and a polymer particulate phase. The polymer continuous phase is formed of an ion electro-conductive rubber material primarily containing a raw rubber A having an intrinsic volume resistivity of $1\times10^{12}$ Ω·cm or less. In addition, the polymer particulate phase is formed of an electronic electro-conductive rubber material obtained by mixing an electro-conductive particle with a raw rubber B and thus having electro-conductivity. In the configuration disclosed in Japanese Patent Application Laid-Open No. 2002-003651, the charging member has the matrix-domain structure formed of the ion electro-conductive rubber material and the electronic electro-conductive rubber material, such that resistance stability of the charging member is excellent.

According to studies conducted by the present inventors, it was found that in all of the electrophotographic processes using the electrophotographic photosensitive member and the charging member disclosed in Japanese Patent Application Laid-Open Nos. H06-51594, 2009-31499, 2016-188931, and 2002-003651, a transfer black spot generated due to a transfer current locally flowing is required to be suppressed.

SUMMARY OF THE INVENTION

An aspect of the present disclosure is directed to providing a process cartridge including an electrophotographic photosensitive member and a charging member and being capable of efficiently suppressing a transfer black spot generated due to a transfer current locally flowing.

According to an aspect of the present disclosure, there is provided a process cartridge detachably attachable to a main body of an electrophotographic apparatus, the process cartridge including an electrophotographic photosensitive member and a charging member, in which the electrophotographic photosensitive member includes a support and a photosensitive layer, when average local potential differences of respective calculated lengths, the calculated lengths each are obtained by defining n as respective integers from 1 to 5,000, are determined based on the following calculation method by using a value obtained by charging an outer surface of the electrophotographic photosensitive member with −500 V, assuming that a straight line having a length of 5,000 μm is placed at an arbitrary position on the charged outer surface, and measuring potentials at measurement points located on the straight line at a pitch of 1 μm, a maximum value of the average local potential differences is 2 V or more, the charging member includes a support and an electro-conductive layer, the electro-conductive layer has a matrix and domains dispersed in the matrix, at least some domains are exposed to an outer surface of the charging member, the matrix contains a first rubber, the domain contains a second rubber and an electronic electro-conductive agent, a volume resistivity $\rho_M$ of the matrix is at least $1.00\times10^5$ times a volume resistivity $\rho_D$ of the domain, and when a calculated length in which a maximum value of the average local potential difference is obtained is defined as $S_{CP}$ [μm] and an arithmetic mean value of distances between wall surfaces of the domains observed on the outer surface of the charging member is defined as $D_{ms}$ [μm], $S_{CP}\geq3\times D_{ms}$, the calculation method including:

i) dividing the straight line into calculated length n×1 μm (where, n is an integer of 1 or more) to obtain 5,000/n [number] regions;

ii) calculating an average value of potentials, the potentials being obtained at all measurement points included in each region;

iii) calculating a difference between regions adjacent to each other with respect to the average value of the potentials at each region calculated in ii) (local potential difference); and iv) calculating an average value of the local potential differences (average local potential difference) obtained between the regions.

Further features of the present invention will become apparent from the following description of exemplary embodiments with reference to the attached drawings.

DESCRIPTION OF THE EMBODIMENTS

Figure 1:
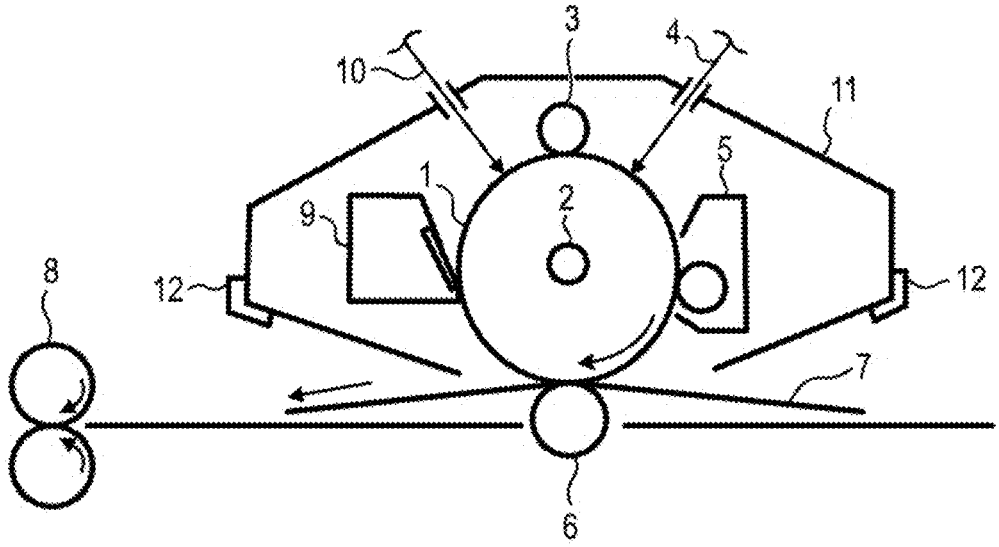
FIG. 1 is a view illustrating an example of a schematic configuration of an electrophotographic apparatus including a process cartridge including an electrophotographic photosensitive member and a charging member.

Hereinafter, a process cartridge according to an aspect of the present disclosure will be described in detail with reference to preferred exemplary embodiments.

A transfer black spot is generated due to a defect occurring on an intermediate transfer belt or a transfer current locally flowing along a foam cell shape of a transfer roller having a foam layer in a direct transfer system. As a result of conducting studies, the present inventors found that the control of the rectifying layer or the surface shape of the photosensitive member disclosed in each of Japanese Patent Application Laid-Open Nos. H06-51594 and 2009-31499 and the control of the AC voltage disclosed in Japanese Patent Application Laid-Open No. 2016-188931 do not have a sufficient effect of suppressing a transfer black spot in some cases. In addition, the effect of suppressing the transfer black spot may also be insufficient in the charging member having the matrix-domain structure formed of the ion electro-conductive rubber material and the electronic electro-conductive rubber material described in Japanese Patent Application Laid-Open No. 2002-003651. Furthermore, even in the process cartridge in which the photosensitive member and the charging member are combined disclosed in each of Japanese Patent Application Laid-Open Nos. H06-51594, 2009-31499, 2016-188931, and 2002-003651, the effect of suppressing the transfer black spot may be insufficient.

Therefore, as a result of conducting intensive studies, the present inventors found that the above problems can be solved by designing a photosensitive member and a charging member as follows and optimizing a combination of the photosensitive member and the charging member.

Configuration of Photosensitive Member

The electrophotographic photosensitive member includes a support and a photosensitive layer. When average local potential differences of respective calculated lengths, the calculated lengths each are obtained by defining n as respective integers from 1 to 5,000, are determined based on the following calculation method by using a value obtained by charging an outer surface of the electrophotographic photosensitive member with −500 V, assuming that a straight line having a length of 5,000 μm is placed at an arbitrary position on the charged outer surface, and measuring potentials at measurement points located on the straight line at a pitch of 1 μm, a maximum value of the average local potential differences is 2 V or more.

<Calculation Method> i) the straight line is divided into calculated length n×1 μm (where, n is an integer of 1 or more) to obtain 5,000/n [number] regions;

ii) an average value of potentials, the potentials being obtained at all measurement points included in each region, is calculated;

iii) a difference between regions adjacent to each other is calculated with respect to the average value of the potentials at each region calculated in ii) (local potential difference); and iv) an average value of the local potential differences (average local potential difference) obtained between the regions is calculated.

Here, when the calculated length in which the maximum value of the average local potential difference is obtained is defined as $S_{CP}$ [μm], the outer surface of the photosensitive member has a potential distribution in which the average local potential difference is 2 V or more with the calculated length $S_{CP}$ [μm] as a unit. That is, the photosensitive member has a potential difference distribution in which a surface potential when the surface of the photosensitive member is charged has a certain level or more of a potential difference (average local potential difference) in a certain period ($S_{CP}$ [μm], hereinafter, also referred to as a potential difference period).

In the photosensitive member, in a case where the outer surface is charged with −500 [V] and a potential distribution is measured, in a graph in which an average local potential difference $V_{mk}$ [V] in the potential distribution is plotted against a calculated length S [μm], $V_{mk}$ has a peak. A maximum value $V_{mk,max}$ [V] of $V_{mk}$ corresponding to the peak is a maximum value of the average local potential difference, that is, 2 [V] or more. In addition, the calculated length S in the peak is $S_{CP}$ [μm].

Configuration of Charging Member

The charging member includes a support and an electro-conductive layer. The electro-conductive layer has a matrix and domains dispersed in the matrix. At least some domains are exposed to an outer surface of the charging member. The matrix contains a first rubber and the domain contains a second rubber and an electronic electro-conductive agent. A volume resistivity $\rho_M$ of the matrix is $1.00\times10^5$ times or more of a volume resistivity $\rho_D$ of the domain.

Figure 2:
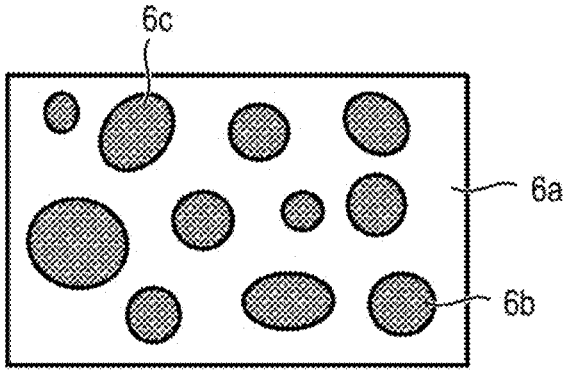
FIG. 2 is a schematic view of a matrix-domain structure observed on an outer surface of the charging member.

FIG. 2 is a schematic view of a matrix-domain structure observed on the outer surface of the charging member. The electro-conductive layer of the charging member has a matrix 6*a* containing a first rubber and of domains 6*b* dispersed in the matrix, and the domain has a matrix-domain structure including a second rubber and an electronic electro-conductive agent 6*c*.

Combination of Photosensitive Member and Charging Member

In the combination of the photosensitive member and the charging member, when an arithmetic mean value of distances between wall surfaces of the domains observed on the outer surface of the charging member (hereinafter, also referred to as a matrix-domain structural period) is defined as $D_{ms}$ [μm], a relationship between $S_{CP}$ and $D_{ms}$ is $S_{CP}\geq3\times D_{ms}$. That is, in the photosensitive member, the potential difference period ($S_{CP}$ [μm]) is greater than the matrix-domain structural period ($D_{ms}$ [μm]) by a certain level or more (3 times or more).

The present inventors consider a mechanism in which the process cartridge obtained by combining the photosensitive member and the charging member is effective in suppressing the transfer black spot generated due to the transfer current locally flowing as follows.

In a transfer process, a potential having a large polarity opposite to that in a charging process is formed on the photosensitive member into a spot shape, the potential cannot be eliminated by pre-exposure or the like and is maintained with a potential difference even after the charging process, and an excess amount of a toner is developed. Accordingly, a transfer black spot is generated due to the transfer current locally flowing. In order to suppress the transfer black spot without depending on the control of the transfer bias, the pre-exposure, and the AC/DC charging, it is required to eliminate the spot-like potential having the polarity opposite to that in the charging process by the DC charging. Therefore, it is preferable that a discharge distribution which is determined by combining the photosensitive member and the charging member in the charging process has a certain degree of electrical randomness.

Here, the term "electrical randomness" refers to an irregular state of the discharge distribution. When the discharge distribution during the charging has electrical randomness, a spot-like potential distribution formed in the transfer process is disturbed and averaged by charges irregularly applied by discharge during the charging. Therefore, the transfer black spot can be efficiently suppressed. It is considered that a mechanism for averaging a charge distribution by the electrical randomness is the same as a mechanism for averaging a charge distribution using optical randomness by using an average local elevation difference described in Japanese Patent Application Laid-Open No. 2013-117624.

In order to exhibit the electrical randomness, it is preferable that a difference between the potential difference period of the photosensitive member and the matrix-domain structural period of the charging member is generated, and a discharge distribution in which a discharge distribution corresponding to the potential difference period and a discharge distribution corresponding to the matrix-domain structural period are superposed is generated during the charging process. When a difference between two periods is not generated, the spot-like potential having a polarity opposite to that in the transfer process is canceled out by a periodic charge distribution in the charging process, and the effect of suppressing the transfer black spot is not sufficiently obtained. In addition, in order to form a discharge distribution corresponding to each of the potential difference period and the matrix-domain structural period with sufficient intensity, the above-described conditions are required for each of the photosensitive member and the charging member. Hereinafter, the reason will be described.

First, it is required for the photosensitive member to have a potential difference distribution in which the maximum value $V_{mk,max}$ of the average local potential difference is 2 V or more. In the graph of the dependency of the average local potential difference on the calculated length, when a potential difference in which $V_{mk,max}\geq2$ is generated in the photosensitive member, a large discharge contrast is generated in the photosensitive member due to a distribution of a current flowing inside the photosensitive member, or the like in a period of $S=S_{CP}$. The large discharge contrast has a magnitude enough to form the discharge distribution caused by the photosensitive member required to obtain the effects according to the present disclosure.

Second, it is required for the matrix of the charging member to have a certain level or more of resistance than that of the domain. When a ratio $\rho_M/\rho_D$ of the volume resistivity $\rho_M$ [Ω·cm] of the matrix to the volume resistivity $\rho_D$ [Ω·cm] of the domain is $1.00\times10^5$ or more, the discharge contrast caused by a resistance contrast between the matrix and the domain of the charging member is increased. Therefore, the discharge distribution caused by the charging member required to obtain the effects according to the present disclosure can be formed.

For the above reasons, when the photosensitive member and the charging member are combined, a discharge distribution corresponding to each of the potential difference period of the photosensitive member and the matrix-domain structural period of the charging member is formed with sufficient intensity. In addition, the two charge distributions are superposed to have electrical randomness. As a result, the spot-like potential having the opposite polarity can be efficiently eliminated, and the transfer black spot generated due to the transfer current locally flowing is suppressed.

Comparison with Related Art

In Japanese Patent Application Laid-Open No. H06-51594, the occurrence of the transfer memory is suppressed by the rectifying layer. However, since there is no measure for eliminating local unevenness by electrical randomness, the effect of suppressing a local transfer black spot is insufficient even though the effect of suppressing a general transfer memory is exhibited.

In addition, in Japanese Patent Application Laid-Open No. H06-51594, a charging roller is disclosed as a charging member, but the matrix-domain structural period included in the charging member according to an aspect of the present disclosure is not disclosed.

In Japanese Patent Application Laid-Open No. 2009-31499, the discharge in the transfer process is controlled by unevenness formed on the surface of the surface layer. However, since there is also no measure for eliminating the local unevenness by electrical randomness, the effect of suppressing a local transfer black spot is insufficient.

In addition, in Japanese Patent Application Laid-Open No. 2009-31499, the corona type charging member is disclosed as a charging member, and the matrix-domain structural period included in the charging member according to an aspect of the present disclosure is not disclosed.

In Japanese Patent Application Laid-Open No. 2016-188931, the photosensitive member having an outermost surface layer including a metal oxide fine particle is disclosed, and the transfer memory is subjected to charge elimination by combining frequency dependence characteristics of impedance of the photosensitive member and frequency control of an AC static discharger. However, since there is also no measure for eliminating the local unevenness by electrical randomness, the effect of suppressing a local transfer black spot is insufficient.

In addition, in Japanese Patent Application Laid-Open No. 2016-188931, the corona type charging member is disclosed as a charging member, and the matrix-domain structural period included in the charging member according to an aspect of the present disclosure is not disclosed.

Japanese Patent Application Laid-Open No. 2002-003651 discloses a charging member having a matrix-domain structural period formed of an ion electro-conductive rubber material and an electronic electro-conductive rubber material. However, a ratio of resistance of the matrix to resistance of the domain that is disclosed in Japanese Patent Application Laid-Open No. 2002-003651 does not satisfy the condition in which the ratio is $1.00\times10^5$ or more according to the present disclosure.

In addition, the photosensitive member disclosed in Japanese Patent Application Laid-Open No. 2002-003651 has no potential difference distribution in which the photosensitive member has a certain level or more of a potential difference in a certain period as specified in the present disclosure.

As described above, the photosensitive member and the charging member disclosed in each of Japanese Patent Application Laid-Open Nos. H06-51594, 2009-31499, 2016-188931, and 2002-003651 are insufficient to optimize the combination for achieving the object of the present disclosure.

As described in the mechanism and the comparison with the related art, the effect according to the present disclosure can be achieved by making a synergy effect between configurations of the photosensitive member and the charging member in the process cartridge according to an aspect of the present disclosure.

Hereinafter, a configuration of the electrophotographic photosensitive member according to an aspect of the present disclosure will be described in detail.

Electrophotographic Photosensitive Member

The electrophotographic photosensitive member includes a support and a photosensitive layer.

In the photosensitive member, when a potential distribution when the surface of the photosensitive member is charged with −500 [V] by the charging member is measured, the maximum value $V_{mk,max}$ [V] of the average local potential difference $V_{mk}$ [V] in the potential distribution in the calculated length $S_{CP}$ [μm] is 2 V or more.

In addition, the maximum value $V_{mk,max}$ of the average local potential difference is preferably 8 V or more from the viewpoint of more efficiently suppressing the transfer black spot.

The calculated length $S_{CP}$ [μm] is preferably in a range of 10 μm to 100 μm. When $S_{CP}$ is 10 μm or more, in the matrix-domain structure of the charging member, an inter-domain distance $D_{ms}$ observed on the outer surface of the charging member is typically in a range from submicron to several microns. Therefore, a difference between the potential difference period of the photosensitive member and a matrix-domain period of the charging member is likely to be generated. In addition, when $S_{CP}$ is 100 μm or less, $S_{CP}$ becomes smaller than a scale of L=L*=183 [μm] in which a maximum value of a VTF curve of the following Equation (E1) showing human visible sensitivity is obtained. Therefore, a transfer black spot having a size that is particularly noticeable to eyes of a human is easily suppressed by periods of $S_{CP}$ and $D_{ms}$.

$$VTF(L)=5.05e^{-138/L}(1-e^{-100/L}) \quad \text{(E1)}$$

(Reference document: P. G. Roetling: Visual Performance and Image Coding, SPIE/OSA, 74, Image Processing, 1976, PP. 195-199)

An example of a method of producing the electrophotographic photosensitive member according to an aspect of the present disclosure can include a method in which coating liquids for layers to be described later are prepared and applied on the layers in a desired order, and the coating layers are dried. In this case, examples of a method of applying a coating liquid can include dip coating, spray coating, ink jet coating, roll coating, die coating, blade coating, curtain coating, wire bar coating, and ring coating. Among them, dip coating is preferable from the viewpoints of efficiency and productivity.

Hereinafter, the respective layers will be described.

Support

The support is preferably an electro-conductive support having electro-conductivity. In addition, examples of a shape of the support can include a cylindrical shape, a belt shape, and a sheet shape. Among them, a cylindrical support is preferable. In addition, a surface of the support may be subjected to an electrochemical treatment such as anodization or a blast treatment.

As a material of the support, a metal, a resin, or glass is preferable.

Examples of the metal can include aluminum, iron, nickel, copper, gold, and stainless steel, or alloys thereof. Among them, an aluminum support obtained by using aluminum is preferable.

In addition, electro-conductivity may be imparted to the resin or glass through a treatment such as mixing or coating of the resin or glass with an electro-conductive material.

The surface of the support may be subjected to a cutting treatment. By performing the cutting treatment, reflection of light on the surface can be controlled.

In particular, a surface of the aluminum support is subjected to a cutting treatment and the photosensitive layer is provided on the surface of the aluminum support, such that the period of the potential difference distribution can be controlled by a period of a cutting pitch. Thus, the dependency of the average local potential difference on the calculated length according to the present disclosure is easily obtained.

Electro-Conductive Layer

The electro-conductive layer may be provided on the support. By providing the electro-conductive layer on the support, scratches or unevenness of the surface of the support can be concealed, or reflection of light on the surface of the support can be controlled.

The electro-conductive layer preferably contains an electro-conductive particle and a resin.

In particular, a distribution period of the electro-conductive particle or the like in the electro-conductive layer can be controlled by controlling selection of the electro-conductive particle and the resin, a mixing ratio of the electro-conductive particle and the resin, a dispersion method of the electro-conductive particle in a coating liquid for an electro-conductive layer, and a thickness of the electro-conductive layer, and providing an appropriate photosensitive layer on the electro-conductive layer. As a result, a potential difference distribution corresponding to the distribution period can be obtained, and the dependency of the average local potential difference on the calculated length according to the present disclosure can be obtained.

In a case where the electro-conductive layer is formed by applying the coating liquid for an electro-conductive layer through a method such as dip coating, and drying the coating liquid, the distribution period can be controlled according to the following mechanism.

Method of Controlling Distribution Period of Electro-Conductive Particle or the like by Benard Convection In a case where a liquid layer is heated from below or cooled from above to form a vertical temperature gradient, when the temperature gradient exceeds a certain threshold, the temperature gradient cannot be resolved by only thermal conduction, and the liquid itself moves. A convection phenomenon that is generated to resolve such a temperature gradient refers to Benard convection. In the Benard convection, the liquid layer is divided into cellular vortex regions having a substantially regular hexagon shape, and the central part of the vortex region becomes an upward flow, and a peripheral part of the vortex region becomes a downward flow.

The coating liquid for an electro-conductive layer is applied onto the support and dried with an oven or the like, thermal conductivity of the support is increased and the solvent is evaporated, such that a large temperature gradient is generated, and a Benard convection is thus generated. After drying is completed in this state, a defect in which a substantially regular hexagon cellular region which is called a Benard cell is filled occurs in the electro-conductive layer, but the defect can be suppressed by adding a leveling agent such as silicone oil. Even though the Benard cell is suppressed, the convection itself is generated during drying. Therefore, a distribution period of the electro-conductive particle or the like corresponding to a Benard convection pitch is obtained by controlling the selection of the electro-conductive particle and the resin, a mixing ratio of the electro-conductive particle and the resin, the dispersion method of the electro-conductive particle in the coating liquid for an electro-conductive layer, or the like.

Here, it is known that a cycle of the Benard convection is about 2'12 times a thickness of the liquid layer. Therefore, as the thickness of the liquid layer is gradually reduced due to the evaporation of the solvent until the drying is completed immediately after the coating liquid for an electro-conductive layer is applied, the cycle of the Benard convection is gradually shortened. Since it is considered that the Benard convection is stopped almost immediately before the solvent is completely evaporated and the drying is completed, the distribution period of the electro-conductive particle or the like is almost $2\sqrt{12}$ times the thickness of the finally obtained electro-conductive layer. For example, in a case where the electro-conductive layer is formed in a thickness of 20 μm by using this fact, a distribution period of $20\times\sqrt{2}\cong 60$ μm is obtained.

Examples of a material of the electro-conductive particle can include metal oxide, a metal, and carbon black.

Examples of the metal oxide can include zinc oxide, aluminum oxide, indium oxide, silicon oxide, zirconium oxide, tin oxide, titanium oxide, magnesium oxide, antimony oxide, and bismuth oxide. Examples of the metal can include aluminum, nickel, iron, nichrome, copper, zinc, and silver.

Among them, the metal oxide is preferably used for the electro-conductive particle. In particular, titanium oxide, tin oxide, or zinc oxide is more preferably used for the electro-conductive particle.

In a case where the metal oxide is used for the electro-conductive particle, a surface of the metal oxide may be treated with a silane coupling agent or the like, or the metal oxide may be doped with an element such as phosphorus or aluminum, or an oxide thereof. Examples of the element doping the metal oxide or an oxide thereof can include phosphorus, aluminum, niobium, and tantalum.

In addition, the electro-conductive particle may have a laminate structure having a core particle and a covering layer that covers the particle. Examples of a material of the core particle can include titanium oxide, barium sulfate, and zinc oxide. An example of a material of the covering layer can include metal oxide such as tin oxide or titanium oxide.

In addition, in a case where the metal oxide is used for the electro-conductive particle, a volume average particle diameter thereof is preferably 1 nm or more and 500 nm or less, and more preferably 3 nm or more and 400 nm or less.

Examples of the resin can include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electro-conductive layer may further contain a masking agent such as silicone oil, a resin particle, or titanium oxide.

An average thickness of the electro-conductive layer is preferably 1 μm or more and 50 μm or less, and particularly preferably 3 μm or more and 40 μm or less.

The electro-conductive layer can be formed by preparing a coating liquid for an electro-conductive layer containing the respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent. Examples of a method for dispersing the electro-conductive particles in the coating liquid for an electro-conductive layer can include methods using a paint shaker, a sand mill, a ball mill, and a liquid collision-type high-speed disperser.

Undercoat Layer

An undercoat layer may be provided on the support or the electro-conductive layer. By providing the undercoat layer, an adhesive function between layers can be increased to impart a charge injection-inhibiting function.

The undercoat layer preferably contains a resin. In addition, the undercoat layer may be formed as a cured film by polymerization of a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group included in the monomer having a polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron transporting substance, metal oxide, a metal, an electro-conductive polymer, or the like, in order to improve electric characteristics. Among them, an electron transporting substance or metal oxide may be preferably used.

Examples of the electron transporting substance can include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the monomer having the polymerizable functional group to form an undercoat layer as a cured film.

Examples of the metal oxide can include indium tin oxide, tin oxide, indium oxide, titanium oxide, zinc oxide, aluminum oxide, and silicon dioxide. Examples of the metal can include gold, silver, and aluminum. A desired potential difference distribution of the photosensitive member that can prevent concealment of an electrical distribution caused by the distribution period of the electro-conductive particle or the like in the electro-conductive layer to some extent is easily obtained by containing the metal oxide.

In addition, the undercoat layer may further contain an additive.

An average thickness of the undercoat layer is preferably 0.1 μm or more and 50 μm or less, more preferably 0.2 μm or more and 40 μm or less, and particularly preferably 0.3 μm or more and 30 μm or less.

However, in a case where the distribution period of the electro-conductive particle or the like in the electro-conductive layer is controlled by the above-described method to obtain the dependency of the average local potential difference on the calculated length according to the present disclosure, it is not preferable that a thick undercoat layer having high resistance is formed to obtain the distribution period as a potential difference distribution of the photosensitive member. In particular, in a case where an undercoat layer which does not contain an electron transporting substance or metal oxide and is formed of a polyamide resin or the like is formed in a thickness of 1.0 μm or more, the electrical distribution caused by the distribution period of the electro-conductive particle or the like in the electro-conductive layer is concealed by the undercoat layer. Therefore, a desired potential difference distribution of the photosensitive member is unlikely obtained.

The undercoat layer can be formed by preparing a coating liquid for an undercoat layer containing the respective materials and a solvent, forming a coating film thereof, and drying and/or curing the coating film. Examples of the solvent used in the coating liquid can include an alcohol-based solvent, a ketone-based solvent, an ether-based solvent, an ester-based solvent, and an aromatic hydrocarbon-based solvent.

Photosensitive Layer

A photosensitive layer of the electrophotographic photosensitive member is mainly classified into (1) a laminate type photosensitive layer and (2) a monolayer type photosensitive layer. (1) The laminate type photosensitive layer includes a charge generation layer containing a charge generating substance and a charge transport layer containing a charge transporting substance. (2) The monolayer type photosensitive layer includes a photosensitive layer containing both a charge generating substance and a charge transporting substance.

(1) Laminate Type Photosensitive Layer

The laminate type photosensitive layer includes a charge generation layer and a charge transport layer.

(1-1) Charge Generation Layer

The charge generation layer preferably contains a charge generating substance and a resin.

Examples of the charge generating substance can include an azo pigment, a perylene pigment, a polycyclic quinone pigment, an indigo pigment, and a phthalocyanine pigment. Among them, an azo pigment or a phthalocyanine pigment is preferable. Among the phthalocyanine pigments, an oxytitanium phthalocyanine pigment, a chlorogallium phthalocyanine pigment, or a hydroxygallium phthalocyanine pigment is preferable.

A content of the charge generating substance in the charge generation layer is preferably 40% by mass or more and 85% by mass or less, and more preferably 60% by mass or more and 80% by mass or less, with respect to a total mass of the charge generation layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferable.

In addition, the charge generation layer may further contain an additive such as an antioxidant or an ultraviolet absorber. Specific examples thereof can include a hindered phenol compound, a hindered amine compound, a sulfur compound, a phosphorus compound, and a benzophenone compound.

An average thickness of the charge generation layer is preferably 0.1 μm or more and 1 μm or less, and more preferably 0.15 μm or more and 0.4 μm or less.

The charge generation layer can be formed by preparing a coating liquid for a charge generation layer containing the respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent.

(1-2) Charge Transport Layer

The charge transport layer preferably contains a charge transporting substance and a resin.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable.

A content of the charge transporting substance in the charge transport layer is preferably 25% by mass or more and 70% by mass or less, and more preferably 30% by mass or more and 55% by mass or less, with respect to a total mass of the charge transport layer.

Examples of the resin can include a polyester resin, a polycarbonate resin, an acrylic resin, and a polystyrene resin. Among them, a polycarbonate resin or a polyester resin is preferable. As the polyester resin, a polyarylate resin is particularly preferable.

A content ratio (mass ratio) of the charge transporting substance to the resin is preferably 4:10 to 20:10 and more preferably 5:10 to 12:10.

In addition, the charge transport layer may also contain additives such as an antioxidant, an ultraviolet absorber, a plasticizer, a leveling agent, a lubricity imparting agent, and an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

An average thickness of the charge transport layer is preferably 5 μm or more and 50 μm or less, more preferably 8 μm or more and 40 μm or less, and particularly preferably 10 μm or more and 30 μm or less.

The charge transport layer can be formed by preparing a coating liquid for a charge transport layer containing the respective materials and a solvent, forming a coating film thereof, and drying the coating film. Examples of the solvent used in the coating liquid can include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is preferable.

(2) Monolayer Type Photosensitive Layer

The monolayer type photosensitive layer can be formed by preparing a coating liquid for a photosensitive layer containing a charge generating substance, a charge transporting substance, a resin, and a solvent, forming a coating film of the coating liquid for a photosensitive layer, and drying the coating film. Examples of materials of the charge generating substance, the charge transporting substance, and the resin are the same as in "(1) Laminate Type Photosensitive Layer".

Protection Layer

A protection layer may be provided on the photosensitive layer. By providing the protection layer, durability of the electrophotographic photosensitive member can be improved.

The protection layer preferably contains an electro-conductive particle and/or a charge transporting substance, and a resin.

Examples of the electro-conductive particle can include metal oxides such as titanium oxide, zinc oxide, tin oxide, and indium oxide.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable.

Examples of the resin can include a polyester resin, an acrylic resin, a phenoxy resin, a polycarbonate resin, a polystyrene resin, a phenol resin, a melamine resin, and an epoxy resin. Among them, a polycarbonate resin, a polyester resin, or an acrylic resin is preferable.

In addition, the protection layer may also be formed as a cured film by polymerization of a composition containing a monomer having a polymerizable functional group. Examples of the reaction in this case can include a thermal polymerization reaction, a photopolymerization reaction, and a radiation polymerization reaction. Examples of the polymerizable functional group included in the monomer having the polymerizable functional group can include an acrylic group and a methacrylic group. A material having charge transporting ability may also be used as the monomer having a polymerizable functional group.

The protection layer may also contain additives such as an antioxidant, an ultraviolet absorber, a plasticizer, a leveling agent, a lubricity imparting agent, and an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

An average thickness of the protection layer is preferably 0.5 μm or more and 10 μm or less, and more preferably 1 μm or more and 7 μm or less.

The protection layer can be formed by preparing a coating liquid for a protection layer containing the respective materials and a solvent, forming a coating film thereof, and drying and/or curing the coating film. Examples of the solvent used in the coating liquid can include an alcohol-based solvent, a ketone-based solvent, an ether-based solvent, a sulfoxide-based solvent, an ester-based solvent, and an aromatic hydrocarbon-based solvent.

Measurement Method of Potential Distribution on Surface of Photosensitive Member The potential distribution on the surface of the photosensitive member can be measured with a surface potential gauge, an electrostatic force microscope (hereinafter, also referred to as an EFM), or the like.

Figure 3:
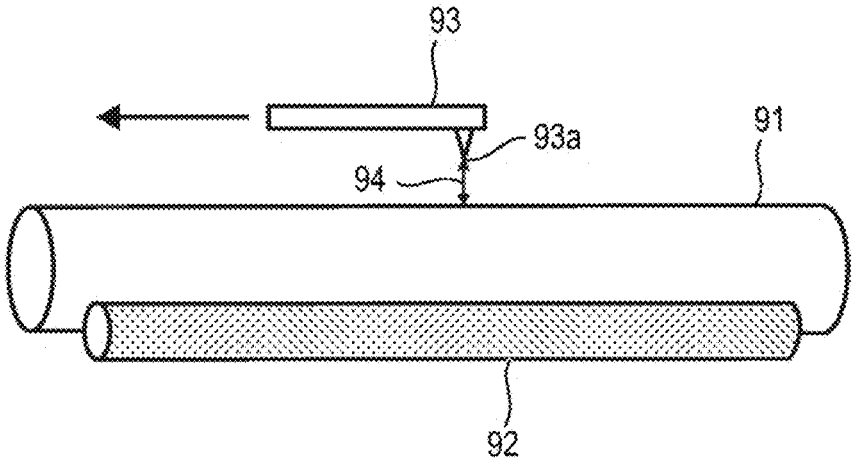
FIG. 3 is a schematic view illustrating a method of measuring a potential on a surface of the electrophotographic photosensitive member with an electrostatic force microscope (EFM).

FIG. 3 illustrates a schematic view of a case of measuring the potential distribution on the surface of the photosensitive member with an EFM. In the measurement of the potential distribution, first, a charging roller 92 as a charging member is brought into contact with a photosensitive member 91, and a surface of the photosensitive member 91 is charged with −500 V while applying a negative voltage to the charging roller 92 and rotating the photosensitive member 91. After the rotation is stopped, a probe 93*a* formed at a distal end of a cantilever 93 of the EFM is brought close to the charged surface of the photosensitive member 91, and a gap 94 between the surface of the photosensitive member 91 and the distal end of the cantilever is set to an appropriate value. Subsequently, the cantilever 93 can be subjected to line scanning in a longitudinal direction of a drum to measure the potential distribution on the surface of the photosensitive member.

In order to clarify a relationship between the average local potential difference of the potential distribution on the surface of the photosensitive member 91 and the calculated length of the photosensitive member 91, it is required to eliminate an influence of the potential distribution caused by the charging roller 92 itself used in the measurement of the potential distribution on the surface of the photosensitive member 91. The method is described as follows.

First, a potential distribution of the photosensitive member 91 is measured by the above-described method using the charging roller 92, and then, separately, a potential distribution of a sample in which a single charge transport layer is formed directly on a support is measured by the above-described method using the charging roller 92. By using a support and a charge transport layer that have a uniform potential distribution, the potential distribution caused by the charging roller 92 itself can be obtained.

Subsequently, a value of the average local potential difference of the calculated lengths is calculated by using potential distribution data obtained by measuring the surface of the photosensitive member 91. In addition, a value of the average local potential difference of the calculated lengths is calculated by using potential distribution data obtained by measuring a surface of the charge transport layer. Thereafter, the value of the average local potential difference of the calculated lengths obtained by the measurement of the charge transport layer is subtracted from the value of the average local potential difference between the calculated lengths obtained by the measurement of the photosensitive member 91. Therefore, a relationship between the average local potential difference and the calculated length of the photosensitive member 91 itself can be clarified.

Calculation Method of Average Local Potential Difference of Calculated Lengths

The potential distribution on the surface of the photosensitive member obtained by "Measurement Method of Potential Distribution on Surface of Photosensitive Member" is subjected the same treatment as in the method of calculating "Dependency of Average Local Elevation Difference (Rmk [μm]) on Calculated Length (L [μm])" described in Japanese Patent Application Laid-Open No. 2013-117624. By doing so, the relationship between the average local potential difference ($V_{mk}$ [V]) and the calculated length (S [μm]) can be clarified. However, the following two points are different from the method described in Japanese Patent Application Laid-Open No. 2013-117624.

Difference 1: In the method described in Japanese Patent Application Laid-Open No. 2013-117624, an average local elevation difference Rmk is calculated by analyzing surface roughness having a length dimension. On the other hand, in the present disclosure, the average local potential difference $V_{mk}$ is calculated by analyzing the surface potential having a voltage dimension.

Difference 2: In the method described in Japanese Patent Application Laid-Open No. 2013-117624, an original height distribution is obtained based on three-dimensional data. That is, the calculation is performed by using data in which one numerical value of a height corresponding to each position coordinate on a two-dimensional plane is obtained. On the other hand, in the present disclosure, in order to simplify the measurement of the potential distribution with an EFM, two-dimensional data is used as an original potential distribution. That is, the calculation is performed by using data in which one numerical value of a potential corresponding to each position coordinate on a one-dimensional straight line is obtained.

In this case, a value obtained by charging the outer surface of the electrophotographic photosensitive member with −500 V, assuming that a straight line having a length of 5,000 μm is placed at an arbitrary position on the charged outer surface, and measuring a potential on the straight line at a pitch of 1 μm is used as the data.

The calculation method of the dependency of the average local potential difference on the calculated length that has the above-described differences can be summarized in the following four procedures.

i) the straight line is divided into calculated length n×1 μm (where, n is an integer of 1 or more) to obtain 5,000/n [number] regions;

ii) an average value of potentials, the potentials being obtained at all measurement points included in each region, is calculated;

iii) a difference between regions adjacent to each other is calculated with respect to the average value of the potentials at each region calculated in ii) (local potential difference); and iv) an average value of the local potential differences (average local potential difference) obtained between the regions is calculated.

Charging Member

Next, a configuration of the charging member according to an aspect of the present disclosure will be described in detail.

Charging Member

The charging member includes a support and an electro-conductive layer.

The electro-conductive layer has a matrix and domains dispersed in the matrix, and at least some domains are exposed to the outer surface of the charging member.

In addition, the matrix contains a first rubber and the domain contains a second rubber and an electronic electro-conductive agent. A volume resistivity $\rho_M$ of the matrix is at least $1.00\times10^5$ times a volume resistivity $\rho_D$ of the domain.

Support

The support is preferably an electro-conductive support having electro-conductivity. In addition, examples of a shape of the support can include a cylindrical shape, a belt shape, and a sheet shape. Among them, a cylindrical support is preferable.

As a material of the support, a metal, a resin, or glass is preferable.

Examples of the metal can include aluminum, iron, nickel, copper, gold, and stainless steel, or alloys thereof. In addition, these materials may be subjected to an oxidation treatment or a plating treatment with chrome, nickel, or the like. As a type of plating, either electroplating or electroless plating can be used, but electroless plating is preferable from the viewpoint of dimensional stability. Here, examples of a type of electroless plating to be used can include nickel plating, copper plating, gold plating, and plating with other various alloys. A thickness of the plating is preferably 0.05 μm or more, and it is preferable that the thickness of the plating is 0.1 μm to 30 μm in consideration of a balance between working efficiency and rust proof ability. The cylindrical shape of the support may be a solid cylindrical shape or a hollow cylindrical (tubular) shape. An outer diameter of the support is preferably in a range of φ 3 mm to φ 10 mm.

Intermediate Layer

An intermediate layer may be provided between the support and the electro-conductive layer. By providing the intermediate layer, adhesion ability between the layers is enhanced, and charge supplying capability can be controlled.

It is preferable that the intermediate layer is a thin film such as a primer and is an electro-conductive resin layer, from the viewpoint of quickly supplying the charges after the consumption of the charges by the discharge in the charging process and thus stabilizing charging.

As the primer, a known primer can be selected depending on a rubber material for electro-conductive layer formation, a material of a support, and the like. Examples of a material of the primer can include a thermosetting resin such as a phenol-based resin, a urethane resin, an acrylic resin, a polyester resin, a polyether resin, or an epoxy resin, and a thermoplastic resin.

Electro-Conductive Layer

The electro-conductive layer has the matrix and the domains dispersed in the matrix, and at least some domains are exposed to the outer surface of the charging member. In addition, the matrix contains a first rubber and the domain contains a second rubber and an electronic electro-conductive agent. A volume resistivity $\rho_M$ of the matrix is at least $1.00\times10^5$ times a volume resistivity $\rho_D$ of the domain.

The arithmetic mean value $D_{ms}$ [μm] of the distances between the wall surfaces of the domains observed on the outer surface of the charging member is preferably 0.2 μm or more and 5.0 μm or less. When $D_{ms}$ is 0.2 μm or more, the domains can be surely separated from each other in a matrix region, and the discharge contrast of the matrix-domain period can be surely obtained. In addition, when $D_{ms}$ is 5.0 μm or less, the potential difference period $S_{CP}$ of the photosensitive member is typically several tens of microns, and thus, the difference between the potential difference period of the photosensitive member and the matrix-domain period of the charging roller is likely to decrease.

In addition, the volume resistivity of the matrix is preferably more than $1.0\times10^{12}$ Ω·cm in viewpoint of obtaining a more remarkable discharge contrast corresponding to the matrix-domain structure.

When the volume resistivity of the matrix is more than $1.0\times10^{12}$ Ω·cm, the discharge from the matrix is greatly suppressed, and the discharge contrast in the charging process is increased. As a result, the discharge contrast corresponding to the matrix-domain structure of the charging member can be more remarkable.

The thickness of the electro-conductive layer is not particularly limited as long as a desired function and effect of the charging member are obtained, but is preferably 1.0 mm or more and 4.5 mm or less.

For example, the charging member can be produced by a method including the following steps (1) to (4):

Step (1): a step of preparing a rubber mixture for domain formation (hereinafter, also referred to as "CMB"), the rubber mixture containing an electronic electro-conductive agent and a second rubber;

Step (2): a step of preparing a rubber mixture for matrix formation (hereinafter, also referred to as "MRC"), the rubber mixture containing a first rubber;

Step (3): a step of preparing a rubber mixture having a matrix-domain structure by kneading CMB and MRC; and Step (4): a step of forming an electro-conductive layer by stacking the rubber mixture prepared in Step (3) on a support directly or with another layer interposed between the rubber mixture and the other layer to form a layer formed of the rubber mixture, and curing the layer formed of the rubber mixture.

Control Method of $\rho_D$, $\rho_M$, and $D_{ms}$

In the electro-conductive layer, the volume resistivity pi) [Ω·cm] of the domain, the volume resistivity $\rho_M$ [Ω·cm] of the matrix, and the distance between the wall surfaces of the domains are controlled as follows. That is, it is preferable that materials used in each of the steps (1) to (4) of producing the charging member are selected and the production conditions are adjusted.

The volume resistivity of the domain can be adjusted by appropriately selecting a type and an added amount of the electronic electro-conductive agent. Examples of a material of the electronic electro-conductive agent compounded in the domain can include oxide such as carbon black, graphite, titanium oxide, or tin oxide, metal oxide such as Cu or Ag, and a particle having a surface coated with metal oxide or a metal. In addition, two types or more of these electronic electro-conductive agents may be compounded and used in combination in an appropriate amount, if necessary.

Among the electronic electro-conductive agents, electro-conductive carbon black having high affinity with rubber and easily controlling a distance between the electronic electro-conductive agents is preferably used. Examples of the carbon black compounded in the domain can include gas furnace black, oil furnace black, thermal black, lamp black, acetylene black, and Ketjen black, but are not limited thereto.

Among them, electro-conductive carbon black having a dibutyl phthalate (DBP) oil absorption amount of 40 $cm^3$/100 g or more and 170 $cm^3$/100 g or less is preferably used from the viewpoint of imparting high electro-conductivity to the domain.

The electronic electro-conductive agent such as the electro-conductive carbon black is preferably compounded in the domain in an amount of 20 parts by mass or more and 150 parts by mass or less with respect to 100 parts by mass of the rubber composition contained in the domain. In particular, a preferred compounded amount of the compounded electronic electro-conductive agent is preferably 50 parts by mass or more and 100 parts by mass or less. The electronic electro-conductive agent having such a content is preferably compounded in a large quantity as compared with a general charging member for electrophotography.

For example, electro-conductive carbon black having a DBP oil absorption amount of 40 $cm^3$/100 g or more and 170 $cm^3$/100 g or less is used as the electronic electro-conductive agent. In this case, CMB is prepared based on a total mass of CMB so that 40% by mass or more and 200% by mass or less of the electro-conductive carbon black is contained, such that $\rho_D$ can be controlled to $1.0\times10^1$ Ω·cm or more and $1.0\times10^4$ Ω·cm or less.

In addition, a filler, a processing aid, a cross-linking aid, a cross-linking accelerator, an antioxidant, a cross-linking accelerator aid, a cross-linking retarder, a softening agent, a dispersant, a colorant, and the like that are generally used as a compounding agent for rubber may be added to the rubber composition for the domain, if necessary, within a range in which the effects according to the present disclosure are not impaired.

Next, the volume resistivity $\rho_M$ of the matrix can be controlled by a composition of MRC.

Examples of the first rubber used in MRC can include natural rubber, butadiene rubber, butyl rubber, acrylonitrile butadiene rubber, urethane rubber, silicone rubber, fluorine rubber, isoprene rubber, chloroprene rubber, styrene-butadiene rubber, ethylene-propylene rubber, and polynorbornene rubber that have low electro-conductivity.

In addition, a filler, a processing aid, a cross-linking agent, a cross-linking aid, a cross-linking accelerator, a cross-linking accelerator aid, a cross-linking retarder, an antioxidant, a softening agent, a dispersant, and a colorant, may be added to MRC, if necessary.

Meanwhile, it is preferable that an electronic electro-conductive agent such as carbon black is not contained in MRC in order to satisfy that $\rho_M/\rho_D \geq 1.00\times10^5$ and $\rho_M > 1.00\times10^{12}$ Ω·cm.

Finally, the distance between the wall surfaces of the domains can be efficiently controlled by adjusting the following four points (a) to (d):

(a) a difference between interfacial tensions a of CMB and MRC;

(b) a ratio $\eta_D/\eta_M$ of a viscosity $\eta_D$ of CMB to a viscosity $\eta_D$ of MRC;

(c): a shear rate γ during kneading of CMB and MRC and an energy amount $E_{DK}$ during shearing in Step (3); and (d) a volume fraction of CMB to MRC in Step (3).

Hereinafter, the respective steps will be described.

a. Difference Between Interfacial Tensions of CMB and MRC

In general, in a case where two types of non-compatible rubbers are mixed, phases thereof are separated. This phenomenon is generated because the same polymers aggregate and free energy is reduced for stabilization due to an interaction between the same polymers stronger than an interaction between different polymers. Since the different polymers are in contact with each other at an interface having a phase-separation structure, the free energy at the interface is higher than inside of the phase-separation structure in which the interaction between the same polymers is stabilized. As a result, the free energy at the interface is reduced, such that an interfacial tension that reduces an area in contact with the different polymers is generated. In a case where the interfacial tension is small, the different polymers tend to be uniformly mixed in order to increase entropy. A state in which the polymers are uniformly mixed refers to dissolution, an SP value to be a criterion of solubility and the interfacial tension tend to be correlated with each other.

That is, it is considered that the difference between the interfacial tensions a of CMB and MRC correlates with the difference between the SP values of the rubbers included in each of CMB and MRC. As the first rubber in MRC and the second rubber in CMB, it is preferable to select rubbers in which a difference between absolute values of SP values is 0.4 $(J/cm^3)^{0.5}$ or more and 5.0 $(J/cm^3)^{0.5}$ or less, and particularly, 0.4 $(J/cm^3)^{0.5}$ or more and 2.2 $(J/cm^3)^{0.5}$ or less. Within this range, the stable phase-separation structure can be formed, and a diameter of the CMB domain can be reduced.

Here, specific examples of the second rubber that can be used in CMB can include natural rubber (NR), isoprene rubber (IR), butadiene rubber (BR), styrene-butadiene rubber (SBR), butyl rubber (IIR), ethylene-propylene rubber (EPM, EPDM), chloroprene rubber (CR), nitrile-butadiene rubber (NBR), hydrogenated nitrile-butadiene rubber (H-NBR), silicone rubber, and urethane rubber (U).

b. Ratio of Viscosity of CMB to Viscosity of MRC

As the ratio $\eta_D/\eta_M$ of the viscosity $\eta_D$ of CMB to the viscosity $n_M$ of MRC closes to 1, a maximum Feret's diameter of the domain can be decreased. Specifically, it is preferable that $\eta_D/\eta_M$ satisfies that $1.0 \leq \eta_D/\eta_D \leq 2.0$. $\eta_D/\eta_M$ can be adjusted by selection of a Mooney viscosity of the raw rubber used in each of CMB and MRC or a type or a compounding amount of a filler. In addition, it is also possible to add a plasticizer such as paraffin oil to an extent that does not inhibit the formation of the phase-separation structure. In addition, the viscosity ratio can be adjusted by adjusting a temperature during kneading. It should be noted that the viscosity of the rubber mixture for domain formation or the rubber mixture for matrix formation can be obtained by measuring the Mooney viscosity [ML] (1+4) at a rubber temperature during kneading based on JIS K6300-1:2013.

c. Shear Rate During Kneading of CMB and MRC/Energy Amount During Shearing

As the shear rate γ during kneading of CMB and MRC is increased, or as the energy amount $E_{DK}$ during shearing is increased, the arithmetic mean value $D_{ms}$ of the distances between the wall surfaces of the domains can be reduced.

γ can be increased by increasing an inner diameter of a stirring member such as a blade or a screw of a kneader, reducing a gap from an end surface of the stirring member to an inner wall of the kneader, or increasing a rotation speed of the stirring member. In addition, $E_{DK}$ can be increased by increasing the rotation speed of the stirring member or increasing the viscosity of each of the second rubber in CMB and the first rubber in MRC.

Volume Fraction of CMB to MRC

A volume fraction of CMB to MRC correlates with a collision coalescence probability between CMBs. Specifically, when the volume fraction of CMB to MRC is reduced, the collision coalescence probability between CMBs is reduced. That is, the volume fraction of CMB to MRC is reduced within a range in which required electro-conductivity is obtained, such that the arithmetic mean value $D_{ms}$ of the distances between the wall surfaces of the domains can be reduced. From this viewpoint, the volume fraction of CMB to MRC is preferably 15% by mass or more and 40% by mass or less.

By controlling $\rho_D$, $\rho_M$, and $D_{ms}$ using the above-described method, an electro-conductive layer in which $\rho_M/\rho_D \geq 1.00\times10^5$, $\rho_M > 1.00\times10^{12}$ Ω·cm, and 0.2 μm≤$D_{ms}$≤5 μm are satisfied can be obtained.

Confirmation Method of Matrix-Domain Structure

The presence or absence of the matrix-domain structural period in the electro-conductive layer can be confirmed by preparing a thin piece from the electro-conductive layer and observing a fracture surface formed on the thin piece in detail.

Examples of a unit for thinning a piece can include a sharp razor, a microtome, and a focused ion beam (FIB). In addition, in order to more accurately observe the matrix-domain structure, a thin piece for observation may be subjected to a pre-treatment capable of preferably obtaining a contrast between the domain and the matrix, such as a dyeing treatment or a vapor deposition treatment.

The fracture surface of the thin piece subjected to fracture surface formation, and if necessary, a pre-treatment can be observed with a laser microscope, a scanning electron microscope (SEM), or a transmission electron microscope (TEM), and the presence or absence of the matrix-domain structure can be confirmed. The observation is preferably performed with a scanning electron microscope (SEM) from the viewpoint simple and accurate confirmation of the matrix-domain structure.

A thin piece of the electro-conductive layer is obtained by the above-described method, and an image is obtained by observing a surface of the thin piece at a magnification of 1,000 to 10,000. Thereafter, a 256 grayscale monochrome image of the obtained image is obtained by performing 8-bits grayscale using image processing software such as ImageProPlus (manufactured by Media Cybernetics, Inc.). Next, a white and black image inversion processing is performed so that the domain in the fracture surface becomes white, and a binarization threshold is set based on the algorithm of Otsu's discrimination analysis method for a luminance distribution of the image, and then the binarized image is obtained. The presence or absence of the matrix-domain structure may be determined by the analyzed image subjected to the image processing in a state where the domain and the matrix are distinguished by binarization.

As illustrated in FIG. 2, by confirming that the structure in which the domains are present in the matrix in an isolated state is included in the analyzed image, the presence or absence of the matrix-domain structure in the electro-conductive layer can be confirmed. The isolated state of the domains may be a state in which each domain is disposed without being connected to another domain, the matrix is in a continuous state in the image, and the domains are separated from each other by the matrix. Specifically, first, a region having a 50 μm square in the analyzed image is used as an analysis region. In this case, a state in which the number of domains present in the isolated state as described above to a total number of a domain group having no contact point with a frame line of the analysis region is 80 number % or more refers to a state having the matrix-domain structure.

The confirmation may be performed by preparing the pieces obtained from 20 points in total, the 20 points being obtained from arbitrary one point of each of regions obtained by evenly dividing the electro-conductive layer of the charging member into five in the longitudinal direction and evenly dividing the electro-conductive layer into four in the circumferential direction.

Measurement Method of Volume Resistivity $\rho_M$ of Matrix

The volume resistivity $\rho_M$ of the matrix can be calculated, for example, by cutting a thin piece having a predetermined thickness (for example, 1 μm) included in the matrix-domain structure from the electro-conductive layer, and bringing a fine probe of a scanning probe microscope (SPM) or an atomic force microscope (AFM) into contact with the matrix in the thin piece.

Figure 4:
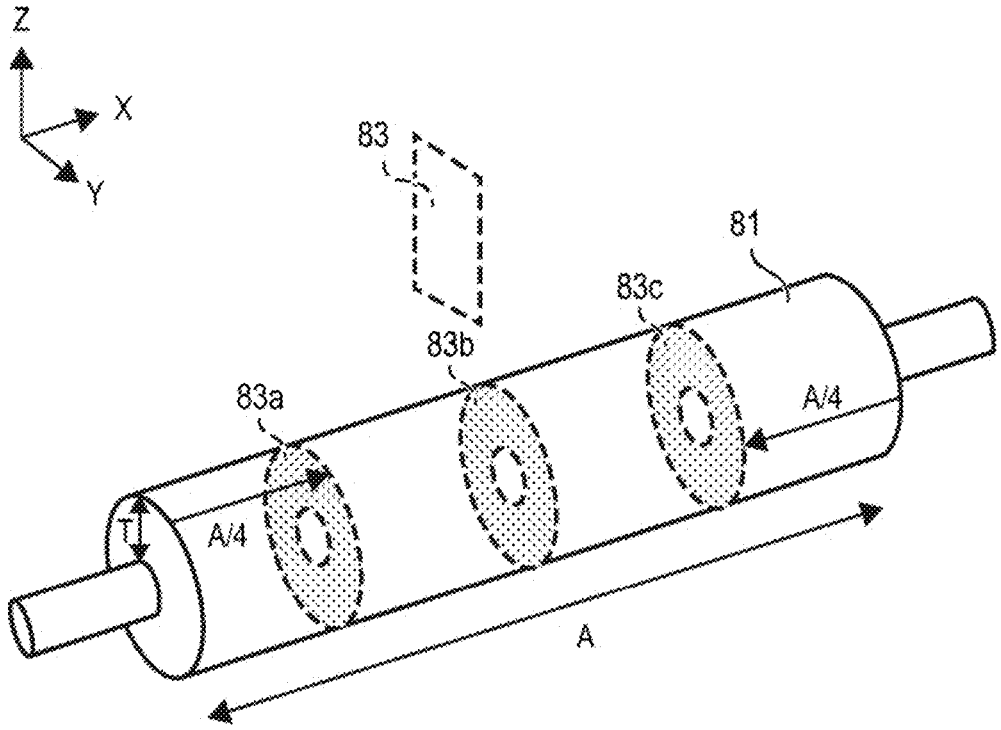
FIG. 4 is a schematic view illustrating a cross section cut out from the charging member.

For example, as illustrated in FIG. 4, when a longitudinal direction of an electro-conductive member is set to an X-axis, a thickness direction of the electro-conductive layer is set to a Z-axis, and a circumferential direction of the electro-conductive layer is set to a Y-axis, the thin piece is cut out from the electro-conductive layer so that the thin piece includes at least a part of a surface parallel to a YZ plane (for example, 83a, 83b, and 83c) perpendicular to an axial direction of the electro-conductive member. The cutting can be performed using, for example, a sharp razor or a microtome, and a focused ion beam (FIB) method.

For the measurement of the volume resistivity, one surface of the thin piece cut out from the electro-conductive layer is grounded. Next, a fine decorated probe of a scanning probe microscope (SPM) or an atomic force microscope (AFM) is brought into contact with a portion of a surface of the matrix that is opposite to the grounded surface of the thin piece, a DC voltage of 50 V is applied thereto for 5 seconds, an arithmetic mean value of values obtained by measuring a ground current value for 5 seconds, and the applied voltage is divided by the calculated value, thereby calculating an electrical resistance value. Finally, the resistance value is converted into a volume resistivity by using a thickness of the thin piece. In this case, the resistance value and the thickness of the thin piece can be simultaneously measured by the SPM or the AFM.

A thin piece sample is cut out from each of regions obtained by dividing the electro-conductive layer into four in the circumferential direction and dividing the electro-conductive layer into five in the longitudinal direction, the measured value is obtained, and then an arithmetic mean value of the volume resistivities of a total of 20 samples is calculated, thereby obtaining a value of the volume resistivity $\rho_M$ of the matrix in a cylindrical charging member.

Measurement Method of Volume Resistivity $\rho_D$ of Domain

The volume resistivity $\rho_D$ of the domain may be measured in the same method as that of "Measurement Method of Volume Resistivity $\rho_M$ of Matrix", except that measurement locations are changed to locations corresponding to the domains, and an applied voltage when measuring the current value is changed to 1 V.

Measurement Method of Arithmetic Mean Value $D_{ms}$ of Distances Between Wall Surfaces of Domains Observed on Outer Surface of Charging Member When a length of the electro-conductive layer in the longitudinal direction is defined as L and a thickness of the electro-conductive layer is defined as T, samples including the outer surface of the charging member are cut out from three portions located at the center of the electro-conductive layer in the longitudinal direction and at two portions corresponding to L/4 from both ends of the electro-conductive layer to the center of the electro-conductive layer, respectively, using a razor. A size of the sample is set to 2 mm in a circumferential direction and a longitudinal direction of the charging member, and a thickness of the sample is set to a thickness T of the electro-conductive layer. In each of the obtained three samples, analysis regions each having a 50 μm square are set at arbitrary three portions of a surface corresponding to the outer surface of the charging member, and images of the three analysis regions are captured with a scanning electron microscope (trade name: S-4800, manufactured by Hitachi High-Technologies Corporation) at a magnification of 5,000. The obtained nine captured images in total are binarized using image processing software (trade name: LUZEX, manufactured by NIRECO CORPORATION). The binarization procedure is performed as follows. A 256 grayscale monochrome image of the captured image is obtained by performing 8-bits grayscale. Then, a white and black image inversion processing is performed, binarization is performed, and a binarized image of the captured image is obtained so that the domain in the captured image becomes white. Next, for each of the nine binarized images, a distance between the wall surfaces of the domains is calculated, and an arithmetic mean value thereof is calculated. The value is defined as $D_{ms}$. It should be noted that the distance between the wall surfaces is a distance between the wall surfaces of the closest domains, and can be calculated by setting a measurement parameter as a distance between adjacent wall surfaces using the image processing software.

Measurement Method of SP Value

An SP value can be accurately calculated by preparing a calibration curve using a material of which an SP value is known. As the known SP value, a catalog value of a raw material manufacturer can be used. For example, NBR and SBR do not depend on a molecular weight, and SP values of NBR and SBR are almost determined by a content ratio of acrylonitrile or styrene.

Therefore, the content ratio of acrylonitrile or styrene in the rubber constituting the matrix and the domain is analyzed by pyrolysis gas chromatography (Py-GC) and a method of analyzing solid NMR. Thereafter, the SP value can be calculated by combining a value of the obtained content ratio and the calibration curve obtained from the material of which the SP value is known.

In addition, an SP value of isoprene rubber is determined in a 1,2-polyisoprene, 1,3-polyisoprene, 3,4-polyisoprene, cis-1,4-polyisoprene, or trans-1,4-polyisoprene isomeric structure. Therefore, similarly to SBR and NBR, the SP value can be calculated by analyzing a content ratio of the isomer by Py-GC and solid NMR and combining the analyzed content ratio and the calibration curve obtained from the material of which the SP value is known.

The SP value of the material of which the SP value is known is obtained by a Hansen sphere method.

Process Cartridge

The process cartridge according to the present disclosure integrally supports the electrophotographic photosensitive member and the charging member described above and is detachably attachable to a main body of an electrophotographic apparatus. The process cartridge according to the present disclosure may integrally support at least one unit selected from the group consisting of a developing unit, a transfer unit, and a cleaning unit.

In the photosensitive member and the charging member included in the process cartridge according to the present disclosure, $S_{CP}$ [μm] of the photosensitive member and $D_{ms}$ [μm] of the charging member are required to satisfy a relationship of $S_{CP} \geq 3 \times D_{ms}$. In addition, it is preferable that $S_{CP} \geq 10 \times D_{ms}$ from the viewpoint of further increasing the electrical randomness and more efficiently suppressing the transfer black spot.

Electrophotographic Apparatus

The electrophotographic apparatus according to the present disclosure includes the electrophotographic photosensitive member and the charging member described above. The electrophotographic apparatus according to the present disclosure may further include an exposing unit, a developing unit, and a transfer unit.

The transfer unit included in the electrophotographic apparatus according to the present disclosure preferably includes a support and a transfer member having an electroconductive foam layer. The transfer member has the electroconductive foam layer, such that capacity of carrying a paper in a direct transfer system is improved and an image defect called a polka dot is suppressed.

In addition, an average cell diameter $L_{tr}$ [μm] of foam cells in the electro-conductive foam layer observed on an outer surface of the transfer member is preferably at least 3 times $S_{CP}$ [μm]. When $L_{tr}$ [μm] is at least 3 times $S_{CP}$ [μm], a period of the transfer black spot generated along a foam cell shape of the transfer member having the foam layer in the direct transfer system is sufficiently increased than that of the potential difference distribution of the photosensitive member. Therefore, the transfer black spot can be efficiently suppressed from the viewpoint the electrical randomness.

Furthermore, $L_{tr}$ [μm] is preferably 200 μm or more and 500 μm or less. The distance $D_{ms}$ between the wall surfaces of the domains in the matrix-domain structure of the charging member is in a range from submicron to several microns, and the potential difference period of the photosensitive member is several 10 μm. Therefore, when $L_{tr}$ [μm] is several 100 μm, all of a generation period of the transfer black spot, the potential difference period of the photosensitive member, and $D_{ms}$ of the charging member vary. As a result, the electrical randomness is further increased, and the transfer black spot derived from the foam cell shape of the transfer member is further suppressed.

In addition, when $L_{tr}$ is 500 μm or less, the transferability of a toner can be improved. Meanwhile, when $L_{tr}$ is 200 μm or more, scattering which is a phenomenon in which a toner transferred to a recording material is not sufficiently held on the recording material can be suppressed.

Figure 5:
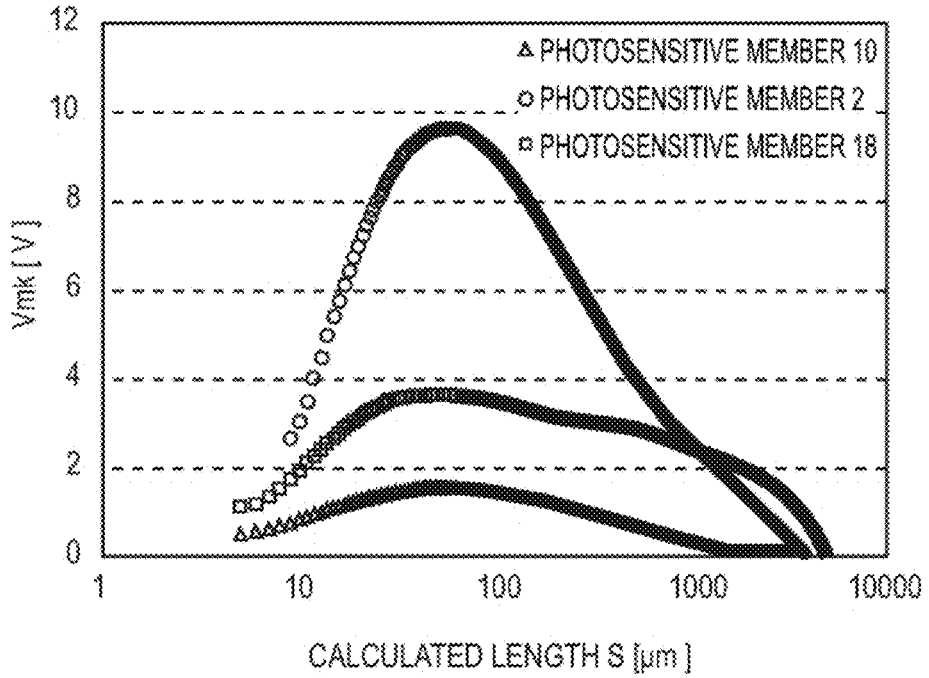
FIG. 5 is a graph showing dependency of an average local potential difference on a calculated length of each of photosensitive members 2, 10, and 18 produced in examples.

In the electrophotographic photosensitive member, the charging member, and the transfer unit, $S_{CP}$, $D_{ms}$, and $L_{tr}$ preferably satisfy a relationship of $3(D_{ms} \cdot L_{tr})^{0.5} \leq S_{CP} \leq 7(D_{ms} \cdot L_{tr})^{0.5}$. $S_{CP}$ satisfying both a relationship in which $S_{CP}$ and $D_{ms}$ satisfy $S_{CP} \geq 3 \times D_{ms}$ and a relationship in which $L_t$r is 3 times or more of $S_{CP}$ with a good balance is in proportion to a geometric mean of $D_{ms}$ and $L_{tr}$. In other words, when a logarithm of each of $S_{CP}$, $D_{ms}$, and $L_{tr}$ is calculated, a logarithm value of $S_{CP}$ is in proportion to an arithmetic mean of the logarithm values of $D_{ms}$ and $L_{tr}$. This means that the electrical randomness is considered as a logarithmic value of the length of each of $S_{CP}$, $D_{ms}$, and $L_{tr}$. As illustrated in FIG. 5, in the graph of the dependency of the average local potential difference on the calculated length, a horizontal axis is expressed as a logarithm. $S_{CP}$, $D_{ms}$, and $L_{tr}$ satisfy the relationship of $3(D_{ms} \cdot L_{tr})^{0.5} \leq S_{CP} \leq 7(D_{ms} \cdot L_{tr})^{0.5}$, such that a difference between the logarithm value of $S_{CP}$ and each of the logarithm value of $D_{ms}$ and the logarithm value of $L_{tr}$ is increased with a balance. Therefore, the above-described electrical randomness can be further increased, and the transfer black spot can be more efficiently suppressed.

Measurement Method of Average Cell Diameter

The average cell diameter of the foam cells in the electroconductive foam layer observed on the surface of the transfer member is preferably measured as follows.

First, the surface of the transfer member is observed using a digital microscope or the like. A 256 grayscale monochrome image of the obtained surface observed image is obtained by performing 8-bits grayscale using image processing software. Next, binarization is performed so that a foam cell portion becomes black, and a diameter of the foam cell portion in the image is calculated as a cell diameter. The diameter in this case is calculated by using an arithmetic mean of a maximum value and a minimum value of the cell diameter of each foam cell.

In the case of a cylindrical transfer member, when a length of the transfer member in a longitudinal direction is defined as B, the surface observed image is obtained from three portions located at the center of the transfer member in the longitudinal direction and at two portions corresponding to B/4 from both ends of the transfer member to the center of the transfer member, respectively. Thereafter, $L_{tr}$ may be calculated as the arithmetic mean value of the cell diameters of the foam cells observed in each of the obtained three surface observed images.

Schematic Configuration of Electrophotographic Apparatus Including Process Cartridge Including Photosensitive Member and Charging Member FIG. 1 illustrates an example of a schematic configuration of the electrophotographic apparatus including the process cartridge including the electrophotographic photosensitive member and the charging member.

Reference numeral 1 represents a cylindrical electrophotographic photosensitive member, and the cylindrical electrophotographic photosensitive member is rotatably driven about a shaft 2 in the arrow direction at a predetermined peripheral velocity. A surface of the electrophotographic photosensitive member 1 is charged to have a predetermined positive or negative potential by a charging unit 3. As illustrated in FIG. 1, the charging unit 3 is operated in a charging manner using a roller type charging member. The charged surface of the electrophotographic photosensitive member 1 is irradiated with exposure light 4 emitted from an exposing unit (not illustrated), and an electrostatic latent image corresponding to target image information is formed on the surface of the electrophotographic photosensitive member 1. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transfer unit 6. A roller type transfer system using a roller type transfer member is illustrated in FIG. 1, but a belt transfer system using a belt shape transfer member or a transfer system using an intermediate transfer member, such as a system in which primary transfer and secondary transfer are combined, may be adopted. Among them, for the above reason, a transfer system using a roller type transfer member having an electro-conductive foam layer is preferable. The transfer material 7 onto which the toner image is transferred is conveyed to a fixing unit 8, is subjected to a treatment for fixing the toner image, and is printed out to the outside of the electrophotographic apparatus. The electrophotographic apparatus may also include a cleaning unit 9 for removing attached materials such as the toner remaining on the surface of the electrophotographic photosensitive member 1 after the transfer. In addition, a so-called cleaner-less system configured to remove the attached materials by the developing unit 5 or the like may be used without separately providing the cleaning unit 9. The electrophotographic apparatus may also include an antistatic mechanism for an antistatic treatment of the surface of the electrophotographic photosensitive member 1 by pre-exposure light 10 emitted from a pre-exposing unit (not illustrated). In addition, a guiding unit 12 such as a rail may be provided for detachably attaching a process cartridge 11 according to the present disclosure to the main body of the electrophotographic apparatus.

The process cartridge according to the present disclosure can be used in a laser beam printer, an LED printer, a copying machine, or the like.

According to an aspect of the present disclosure, it is possible to provide a process cartridge including an electrophotographic photosensitive member and a charging member and being capable of efficiently suppressing a transfer black spot generated due to a transfer current locally flowing.

EXAMPLES

Hereinafter, the present disclosure will be described in more detail with reference to examples and comparative examples. The present disclosure is not limited by the following examples without departing from the gist of the present disclosure. Further, in the description of the following examples, unless otherwise specified, the term "part(s)" is on a mass basis.

A thickness of each layer of the electrophotographic photosensitive member of each of the examples and the comparative examples except for a charge generation layer was measured by a method using an eddy current film thickness gauge (Fischerscope, manufactured by FISCHER INSTRUMENTS K.K.) or a method of converting a mass per unit area into a specific gravity. A thickness of the charge generation layer was measured by conversion of a Macbeth density value of a photosensitive member by using a calibration curve obtained from a Macbeth density value and a thickness measurement value obtained through observation of a cross section SEM image in advance. Here, the Macbeth density value was measured by pressing a spectral densitometer (trade name: X-Rite504/508, manufactured by X-Rite, Incorporated) against a surface of the photosensitive member.

Production of Titanium Oxide Particle 1

Anatase-type titanium oxide of which a primary particle diameter average is 200 nm was used as a base material. In addition, $TiO_2$ and $Nb_2O_5$ were dissolved in sulfuric acid to prepare a titanium-niobium sulfuric acid solution containing 33.7 parts of titanium in terms of $TiO_2$ and 2.9 parts of niobium in terms of $Nb_2O_5$. 100 parts of the base material were dispersed in pure water to obtain 1,000 parts of a suspension, and the suspension was heated to 60° C. The entire titanium-niobium sulfuric acid solution and 10 mol/L of sodium hydroxide were added dropwise to the suspension over 3 hours so that a pH of the suspension was 2 to 3. After the addition, the pH was adjusted to a value near a neutral region, and a polyacrylamide-based aggregation agent was added to the suspension to deposit a solid content. A supernatant was removed, and a residual suspension was filtered, washed, and then dried at 110° C., thereby obtaining an intermediate containing 0.1% by mass of an organic matter derived from the aggregation agent in terms of C. The intermediate was calcined in nitrogen at 750° C. for 1 hour, and then was calcined in air at 450° C., thereby producing a titanium oxide particle 1. An average particle diameter (average primary particle diameter) of the obtained particle that is measured by a particle diameter measurement method using the scanning electron microscope was 220 nm.

Pigment Synthesis Example 1

In an atmosphere of a nitrogen flow, 5.46 parts of orthophthalonitrile and 45 parts of α-chloronaphthalene were injected into a reactor, heating was performed, and the temperature was increased to 30° C. and kept at 30° C. Next, 3.75 parts of gallium trichloride were injected into the reactor at the temperature (30° C.). A moisture concentration in the mixed solution at the time of the injection was 150 ppm. Thereafter, the temperature was increased to 200° C. Next, in an atmosphere of a nitrogen flow, the mixed solution was reacted at a temperature of 200° C. for 4.5 hours, the mixed solution was cooled, and when the temperature reached 150° C., a product was filtered. The obtained filtrate was dispersed and washed by using N,N-dimethylformamide at a temperature of 140° C. for 2 hours and then was filtered. The obtained filtrate was washed with methanol and dried, thereby obtaining a chlorogallium phthalocyanine pigment with a yield of 71%.

Pigment Synthesis Example 2

4.65 parts of the chlorogallium phthalocyanine pigment obtained in Synthesis Example 1 were dissolved in 139.5 parts of concentrated sulfuric acid at a temperature of 10° C., the mixture was added dropwise to 620 parts of iced-water while being stirred to reprecipitate the mixture, and the mixture was filtered under reduced pressure using a filter press. In this case, No. 5C (produced by Advantech Co., Ltd.) was used as the filter. The obtained wet cake (filtrate) was dispersed and washed with 2% ammonium water for 30 minutes and then filtered using a filter press. Next, the obtained wet cake (filtrate) was dispersed and washed with ion-exchanged water, and filtration using the filter press was repeated 3 times. Finally, freeze-drying was performed to obtain a hydroxygallium phthalocyanine pigment (hydrous hydroxygallium phthalocyanine pigment) having a solid content of 23% with a yield of 97%.

Pigment Synthesis Example 3

6.6 kg of the hydroxygallium phthalocyanine pigment obtained in Synthesis Example 2 was dried using a hyper drier (trade name: HD-06R, frequency (oscillation frequency): 2,455 MHz±15 MHz, manufactured by BIOCON LTD.) as follows.

The hydroxygallium phthalocyanine pigment removed from the filter press (hydrous cake thickness: 4 cm or less) was placed on a dedicated circular plastic tray in a mass state, and the dryer was set so that far infrared rays were turned off and an internal temperature of the dryer was 50° C. Then, when the hydroxygallium phthalocyanine pigment was irradiated with microwaves, a vacuum pump and a leak valve were adjusted to adjust a degree of vacuum to 4.0 kPa to 10.0 kPa.

First, as a first step, the hydroxygallium phthalocyanine pigment was irradiated with 4.8 kW of microwaves for 50 minutes. Next, the microwaves were temporarily turned off and the leak valve was temporarily closed to produce a high vacuum state of 2 kPa or less. A solid content of the hydroxygallium phthalocyanine pigment at this time was 88%. As a second step, the leak valve was adjusted, and the degree of vacuum (a pressure inside the dryer) was adjusted to be within above-described set value (4.0 kPa to 10.0 kPa). Thereafter, the hydroxygallium phthalocyanine pigment was irradiated with 1.2 kW of microwaves for 5 minutes. In addition, the microwaves were temporarily turned off and the leak valve was temporarily closed to produce a high vacuum state of 2 kPa or less. The second step was further repeated once (two times in total). A solid content of the hydroxygallium phthalocyanine pigment at this time was 98%. In addition, as a third step, the hydroxygallium phthalocyanine pigment was irradiated with microwaves in the same manner as that in the second step, except that the power of the microwaves in the second step was changed from 1.2 kW to 0.8 kW. The third step was further repeated once (two times in total). In addition, as a fourth step, the leak valve was adjusted, and the degree of vacuum (the pressure inside the dryer) was restored to be within above-described set value (4.0 kPa to 10.0 kPa). Thereafter, the hydroxygallium phthalocyanine pigment was irradiated with 0.4 kW of microwaves for 3 minutes. In addition, the microwaves were temporarily turned off and the leak valve was temporarily closed to produce a high vacuum state of 2 kPa or less. The fourth step was further repeated 7 times (8 times in total). 1.52 kg of the hydroxygallium phthalocyanine pigment (crystal) having a water content of 1% or less was obtained over 3 hours in total.

Milling Example 1

0.5 parts of the hydroxygallium phthalocyanine pigment obtained in Pigment Synthesis Example 3, 9.5 parts of N,N-dimethylformamide (product code: D0722, produced by Tokyo Chemical Industry Co., Ltd.), and 15 parts of glass beads having a diameter of 0.9 mm were prepared. These materials were subjected to milling at room temperature (23° C.) for 100 hours with a ball mill. At this time, a standard bottle (trade name: PS-6, manufactured by HAKUYO GLASS Co., Ltd.) was used as a container, and the container was rotated 60 times for 1 minute. The thus treated solution was filtered with a filter (product number: N-NO. 125T, pore diameter: 133 μm, manufactured by NBC Meshtec Inc.) to remove the glass beads. 30 parts of N,N-dimethylformamide were added to the solution, the solution was filtered, and a filtrate in the filter was sufficiently washed with tetrahydrofuran. Then, the washed filtrate was dried in vacuum, and 0.48 parts of a hydroxygallium phthalocyanine pigment were obtained. The obtained pigment has peaks at Bragg angles 2θ of 7.4°±0.3° and 28.2°±0.3° in an X-ray diffraction spectrum using a CuKα line.

Production Example 1 of Support

An aluminum cylinder (JIS-A3003, aluminum alloy) having a length of 246 mm and a diameter of 24 mm obtained by a production method including an extrusion step and a drawing step was used as a non-anodized support 1.

Production Example 2 of Support

A cutting blade in which a cutting pitch was adjusted to 10 μm was pressed against one end of an aluminum cylinder having a length of 246 mm and a diameter of 24 mm at a depth of 1.8 μm to fix a cutting bite to a lathe. Thereafter, the one end of the aluminum cylinder was cut out by moving the cutting blade of the cutting bite to the other end of the aluminum cylinder at a feed speed of 200 μm per rotation of the aluminum cylinder while rotating the aluminum cylinder. As a result, a support 2 was obtained.

Production Example 3 of Support

A support 3 was obtained in the same operation as that of Production Example 2 of the support, except that in Production Example 2 of the support, the cutting blade was adjusted to have a cutting pitch of 50 μm.

Production Example 4 of Support

A support 4 was obtained in the same operation as that of Production Example 2 of the support, except that in Production Example 2 of the support, the cutting blade was adjusted to have a cutting pitch of 100 μm.

Production Example 5 of Support

A support 5 was obtained in the same operation as that of Production Example 2 of the support, except that in Production Example 2 of the support, the cutting blade was adjusted to have a cutting pitch of 200 μm.

Production Example 6 of Support

A support 6 was obtained in the same operation as that of Production Example 2 of the support, except that in Production Example 2 of the support, the cutting blade was adjusted to have a cutting pitch of 500 μm.

Preparation of Coating Liquid 1 for Electro-Conductive Layer 100 parts of a zinc oxide particle (average primary particle diameter: 50 nm, specific surface area: 19 $m^2/g$, powder resistance: $1.0\times10^7$ Ω·cm, produced by TAYCA CORPORATION) were mixed with 500 parts of toluene under stirring. 0.75 parts of N-2-(aminoethyl)-3-aminopropylmethyldimethoxysilane (trade name: KBM-602, produced by Shin-Etsu Chemical Co., Ltd.) as a surface treatment agent were added to the mixture, and mixing was performed while stirring the mixture for 2 hours. Thereafter, the toluene was removed by distillation under reduced pressure, and drying was performed at 120° C. for 3 hours, thereby obtaining a surface-treated zinc oxide particle.

Subsequently, the following materials were prepared.

100 parts of the surface-treated zinc oxide particle 12 parts of the titanium oxide particle 1

30 parts of a blocked isocyanate compound represented by the following Formula (A1) (trade name: Sumidur 3175, solid content: 75% by mass, produced by Sumitomo Bayer Urethane Co., Ltd.)

(A1)

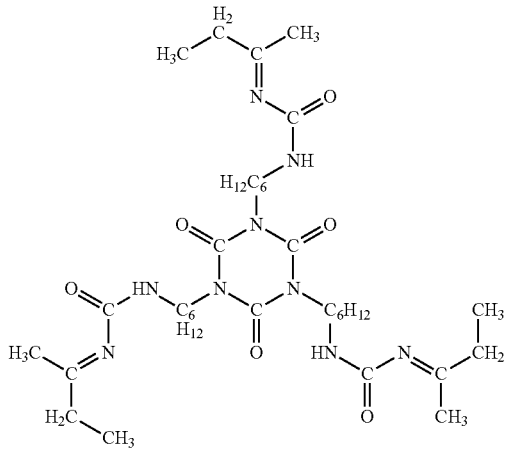

15 parts of a polyvinyl butyral resin (trade name: S-LEC BM-1, produced by SEKISUI CHEMICAL Co., Ltd.)

1 part of 2,3,4-trihydroxybenzophenone (produced by Tokyo Chemical Industry Co., Ltd.)

These materials were added to a solution in which 70 parts of methyl ethyl ketone and 70 parts of cyclohexanone were mixed with each other, thereby preparing a dispersion.

The dispersion was subjected to a dispersion treatment in an atmosphere of 23° C. and a rotation speed of 1,500 rpm for 3 hours with a vertical sand mill by using glass beads having an average diameter of 1.0 mm. After the dispersion treatment, 7 parts of a cross-linked polymethyl methacrylate particle (trade name: SSX-103, average particle diameter: 3 μm, produced by SEKISUI CHEMICAL Co., Ltd.) and 0.01 parts of silicone oil (trade name: SH28PA, produced by Dow Corning Toray Co., Ltd.) were added to the obtained dispersion. Thereafter, the mixture was stirred to prepare a coating liquid 1 for an electro-conductive layer.

Preparation of Coating Liquid 2 for Electro-Conductive Layer

The following materials were prepared.

60 parts of a barium sulfate particle covered with tin oxide (average primary particle diameter: 340 nm, trade name: Pastlan PC1, produced by MITSUI MINING & SMELTING CO., LTD.)

15 parts of a titanium oxide particle (average primary particle diameter: 270 nm, trade name: TITANIX JR, produced by TAYCA CORPORATION)

43 parts of a resol-type phenol resin (trade name: PHENOLITE J-325, produced by DIC Corporation, solid content: 70% by mass)

0.015 parts of silicone oil (trade name: SH28PA, produced by Dow Corning Toray Co., Ltd.)

3.6 parts of a silicone resin particle (trade name: TOSPEARL 120, produced by Momentive Performance Materials Inc.)

50 parts of 2-methoxy-1-propanol 50 parts of methanol

These materials were charged into a ball mill and subjected to a dispersion treatment for 20 hours, thereby preparing a coating liquid 2 for an electro-conductive layer.

Preparation of Coating Liquid 3 for Electro-Conductive Layer 50 parts of a phenol resin (a monomer/oligomer of the phenol resin) (trade name: PHENOLITE J-325, produced by DIC Corporation, resin solid content: 60%, density after curing: 1.3 $g/cm^2$) were prepared as a binding material. The phenol resin was dissolved in 35 parts of 1-methoxy-2-propanol which was used as a solvent.

60 parts of the obtained titanium oxide particle 1 were added to the obtained solution, the mixture was charged into a vertical sand mill using 120 parts of glass beads having an average particle diameter of 1.0 mm as a dispersion medium. A dispersion treatment was performed under conditions of a dispersion temperature of 23±3° C. and a rotation speed of 1,500 rpm (peripheral speed of 5.5 m/s) for 4 hours, thereby obtaining a dispersion. The glass beads were removed from the dispersion with a mesh. Here, the following materials were prepared.

0.01 parts of silicone oil (trade name: SH28 PAINT ADDITIVE, produced by Dow Corning Toray Co., Ltd.) as a leveling agent 8 parts of a silicone resin particle (trade name: KMP-590, produced by Shin-Etsu Chemical Co., Ltd., average particle diameter: 2 μm, density: 1.3 $g/cm^3$) as a surface roughness-imparting material These materials were added to the dispersion from which the glass beads were removed, the mixture was stirred, and the mixture was subjected to pressure-filtration using a PTFE filter paper (trade name: PF060, manufactured by Advantec Toyo Kaisha, Ltd.), thereby preparing a coating liquid 3 for an electro-conductive layer.

Preparation of Coating Liquid 4 for Electro-Conductive Layer

A coating liquid 4 for an electro-conductive layer was prepared in the same operation as that in the preparation of the coating liquid 3 for an electro-conductive layer, except that, the number of parts of the titanium oxide particle 1 used in the preparation of the coating liquid 3 for an electro-conductive layer was changed to 57 parts.

Preparation of Coating Liquid 1 for Undercoat Layer

A solution obtained by dissolving 25 parts of N-methoxymethylated nylon 6 (trade name: Toresin EF-30T, manufactured by Nagase ChemteX Corporation) in 480 parts of a mixed solution of methanol and n-butanol (methanol/n-butanol=2/1) (heating dissolution at 65° C.) was cooled. Thereafter, the solution was filtered with a membrane filter (trade name: FP-022, pore diameter: 0.22 μm, produced by Sumitomo Electric Industries, Ltd.), thereby preparing a coating liquid 1 for an undercoat layer.

Preparation of Coating Liquid 2 for Undercoat Layer 100 parts of a rutile-type titanium oxide particle (trade name: MT-600B, average primary particle diameter: 50 nm, produced by TAYCA Corporation) were mixed with 500 parts of toluene by stirring, 5.0 parts of vinyltrimethoxysilane (trade name: KBM-1003, produced by Shin-Etsu Chemical Co., Ltd.) were added thereto, and the mixture was stirred for 8 hours. Thereafter, the toluene was removed by distillation under reduced pressure and dried at 120° C. for 3 hours, thereby obtaining a rutile-type titanium oxide particle subjected to a surface treatment with vinyltrimethoxysilane.

Subsequently, the following materials were prepared.

18 parts of the rutile-type titanium oxide particle subjected to a surface treatment with vinyltrimethoxysilane 4.5 parts of N-methoxymethylated nylon (trade name: Toresin EF-30T, manufactured by Nagase ChemteX Corporation)

1.5 parts of a copolymer nylon resin (trade name: Amilan CM8000, produced by Toray Industries Inc.)

These materials were added to a solution in which 90 parts of methanol and 60 parts of 1-butanol were mixed with each other, thereby preparing a dispersion. The dispersion was dispersed by using glass beads having a diameter of 1.0 mm with a vertical sand mill for 5 hours, thereby preparing a coating liquid 2 for an undercoat layer.

Preparation of Coating Liquid for Charge Generation Layer

The following materials were prepared.

20 parts of the hydroxygallium phthalocyanine pigment obtained in Milling Example 1

10 parts of polyvinyl butyral (trade name: S-LEC BX-1, produced by SEKISUI

CHEMICAL Co., Ltd.)

190 parts of cyclohexanone 482 parts of glass beads having a diameter of 0.9 mm

These materials were subjected to a dispersion treatment with a sand mill (K-800, manufactured by Igarashi Machine Production Co., Ltd. (currently, AIMEX CO., Ltd.), disk diameter: 70 mm, the number of disks: 5) under a condition of a cooling water temperature of 18° C. for 4 hours. In this case, the disk was operated under a condition of 1,800 rotations for 1 minute. 444 parts of cyclohexanone and 634 parts of ethyl acetate were added to the dispersion, thereby preparing a coating liquid for a charge generation layer.

Preparation of Coating Liquid for Charge Transport Layer

The following materials were prepared.

70 parts of a triarylamine compound represented by the following Formula (A2) as a charge transporting substance (A2)

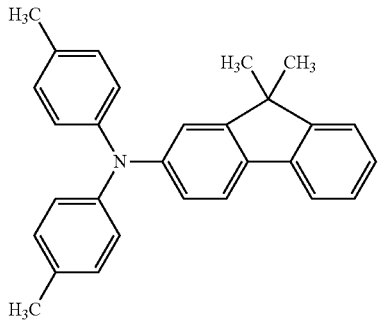

10 parts of a triarylamine compound represented by the following Formula (A3) as a charge transporting substance (A3)

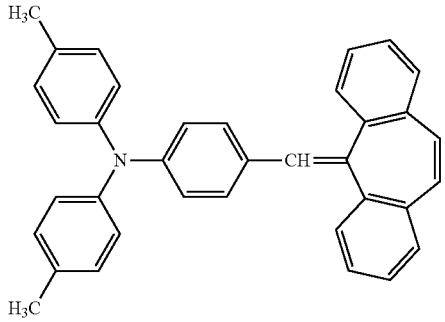

100 parts of polycarbonate (trade name: Iupilon Z-200, produced by Mitsubishi Engineering-Plastics Corporation)

These materials were dissolved in 630 parts of monochlorobenzene, thereby preparing a coating liquid for a charge transport layer.

Production of Electrophotographic Photosensitive Member

Production of Photosensitive Member 1

The coating liquid 1 for an electro-conductive layer was applied onto the support 1 subjected no cutting treatment by dip coating to form a coating film, and the coating film was dried at 170° C., thereby forming an electro-conductive layer having a thickness of 5.0 μm.

Next, the coating liquid for a charge generation layer was applied onto the electro-conductive layer by dip coating to form a coating film, and the coating film was dried at 100° C. for 10 minutes, thereby forming a charge generation layer having a thickness of 150 nm.

Next, the coating liquid for a charge transport layer was applied onto the charge generation layer by dip coating to form a coating film, and the coating film was dried at 120° C. for 60 minutes, thereby forming a charge transport layer having a thickness of 14 μm.

The coating films of the charge generation layer and the charge transport layer were subjected to a heating treatment using an oven whose temperature was set to each temperature. As described above, a cylindrical (drum-like) photosensitive member 1 was produced.

In the obtained photosensitive member 1, a maximum value $V_{mk,max}$ [V] of an average local potential difference and a calculated length $S_{CP}$ [μm] were measured and calculated by the above-described method, specifically, as follows.

A potential distribution on a surface of the photosensitive member was measured with an EFM (trade name: MODEL 1100 TN, manufactured by TREK JAPAN). At this time, a gap between the surface of the photosensitive member and a distal end of a cantilever was set to 10 μm, and the cantilever was scanned in a line of 5 mm in a longitudinal direction of a drum. In the scanning step using the EFM, a width was set to 1 μm, and a measurement speed was set to 20 μm/s. In addition, the photosensitive member was charged in an environment of a temperature of 23° C. and a relative humidity of 50% using a charging roller 9 to be described below. In addition, a sample of a monolayer type material for a charge transport layer used in measurement for eliminating an influence of the potential distribution caused by the charging roller itself was produced by forming a charge transport layer having a thickness of 14 μm on the support 1 by using the coating liquid for a charge transport layer used in the production of the photosensitive member 1.

In the calculation of the calculated length $S_{CP}$ [μm], the dependency of the average local potential difference on the calculated length was calculated by the four procedures i), ii), iii), and iv) described above, specifically, as follows.

i) and ii): When a 5,000 μm straight line is divided into 5,000 with intervals of 1 μm, one end point of the straight line is set to i=0 and the other end point of the straight line is set to i=5,000 (where, i is an integer value). Then, the obtained potential data is expressed as V(i) [V] (where, i=0, 1, . . . , and 5,000).

Next, i in a range of $-5{,}000 \le i \le -1$ is defined as V(i)=V(−i), and i in a range of $5{,}001 \le i \le 10{,}000$ is further defined as V(i)=V(10,000−i), such that the original potential data V(i) ($0 \le i \le 5{,}000$) is extended to a range of $-5{,}000 \le i \le 10{,}000$.

Based on the above preparation, $V_n(j)$ (where, j is an integer value of $-5{,}000 \le j \le 5{,}001$) is calculated by the following Equation (E2) with respect to n (n is an integer of 1 or more) which determines the calculated length.

$$V_n(j) = \frac{1}{n}\sum_{i=j}^{j+n-1} V(i) \tag{E2}$$

The thus obtained $V_n(j)$ is an average value of the potentials at all of the measured points included in each region obtained by dividing the original data V(i) by n×1 μm.

iii) Subsequently, a local potential difference $\Delta V_n(j)$ is calculated by the following Equation (E3).

$$\Delta V_n(j) = \frac{1}{2}\sum_{\mu=\pm 1} |V_n(j) - V_n(j+\mu n)| \tag{E3}$$

iv) Finally, an average local potential difference $V_{mk}$ is calculated by the following Equation (E4).

$$V_{mk} = \frac{1}{5000}\sum_{j=1}^{5000} \Delta V_n(j) \tag{E4}$$

The dependency of the average local potential difference on the calculated length was calculated by calculating 5,000 of the thus obtained average local potential differences $V_{mk}$ for n of 1, 2, 3, . . . , and 5,000 and corresponding the calculated values to the calculated length S=n×1 μm.

The obtained results are shown in Table 1 together with a configuration of the photosensitive member 1.

In Table 1, "CPL" refers to the "electro-conductive layer" and "UCL" refers to the "undercoat layer".

Production of Photosensitive Members 2 to 34

Photosensitive members 2 to 34 were produced in the same manner as that of the production of the photosensitive member 1, except that in the production of the photosensitive member 1, the type of the support, the type of the coating liquid for an electro-conductive layer, the thickness of the electro-conductive layer, the type of the coating liquid for an undercoat layer, and the thickness of the undercoat layer were changed as shown in Table 1.

The drying temperature and the drying time when performing the application of the coating liquids 1 to 4 for an electro-conductive layer by dip coating are as follows.

Coating liquid 1 for electro-conductive layer: drying temperature: 170° C., drying time: 30 minutes Coating liquid 2 for electro-conductive layer: drying temperature: 145° C., drying time: 20 minutes Coating liquid 3 for electro-conductive layer: drying temperature: 150° C., drying time: 20 minutes Coating liquid 4 for electro-conductive layer: drying temperature: 150° C., drying time: 20 minutes The drying temperature and the drying time are not changed according to the type of the coating liquid for an electro-conductive layer regardless of a thickness of a film to be formed.

In addition, the drying temperature and the drying time when performing the application of the coating liquids 1 and 2 for an undercoat layer by dip coating are as follows.

Coating liquid 1 for undercoat layer: drying temperature: 100° C., drying time: 10 minutes Coating liquid 2 for undercoat layer: drying temperature: 100° C., drying time: 10 minutes The drying temperature and the drying time are not changed according to the type of the coating liquid for an undercoat layer regardless of a thickness of a film to be formed.

Further, in Table 1, "-" refers to that the corresponding layer is not formed.

In addition, $V_{mk,max}$ [V] and $S_{CP}$ [μm] of each of the photosensitive members 2 to 34 were measured and calculated in the same manner as those of the photosensitive member 1. The results are shown in Table 1 together with a configuration of each of the photosensitive members 2 to 34.

TABLE 1

| Photosensitive member No. | Support No. | CPL coating liquid No. | CPL thickness [μm] | UCL coating liquid No. | UCL thickness [μm] | Physical property value Scp [μm] | Vmk,max [V] |
|---|---|---|---|---|---|---|---|
| | Each layer of photosensitive member | | | | | | |
| 1 | 1 | 1 | 5.0 | — | — | 15 | 9.2 |
| 2 | 1 | 1 | 18.0 | — | — | 53 | 9.4 |
| 3 | 1 | 1 | 30.0 | — | — | 82 | 9.5 |
| 4 | 1 | 1 | 50.0 | — | — | 145 | 9.6 |
| 5 | 1 | 2 | 5.0 | — | — | 13 | 6.0 |
| 6 | 1 | 2 | 15.0 | — | — | 52 | 6.1 |
| 7 | 1 | 2 | 26.0 | — | — | 76 | 6.3 |
| 8 | 1 | 2 | 50.0 | — | — | 139 | 6.4 |
| 9 | 1 | 2 | 5.0 | 1 | 1.0 | 13 | 1.3 |

TABLE 1-continued

| Photosensitive member No. | Each layer of photosensitive member: Support No. | CPL coating liquid No. | CPL thickness [μm] | UCL coating liquid No. | UCL thickness [μm] | Physical property value: Scp [μm] | Vmk,max [V] |
|---|---|---|---|---|---|---|---|
| 10 | 1 | 2 | 15.0 | 1 | 1.0 | 46 | 1.5 |
| 11 | 1 | 2 | 26.0 | 1 | 1.0 | 72 | 1.6 |
| 12 | 1 | 2 | 50.0 | 1 | 1.0 | 140 | 1.7 |
| 13 | 1 | 2 | 5.0 | 1 | 1.2 | 13 | 1.2 |
| 14 | 1 | 2 | 15.0 | 1 | 1.2 | 45 | 1.2 |
| 15 | 1 | 2 | 26.0 | 1 | 1.2 | 73 | 1.4 |
| 16 | 1 | 2 | 50.0 | 1 | 1.2 | 148 | 1.5 |
| 17 | 1 | 3 | 5.0 | — | — | 15 | 3.3 |
| 18 | 1 | 3 | 15.0 | — | — | 52 | 3.6 |
| 19 | 1 | 3 | 25.0 | — | — | 71 | 3.7 |
| 20 | 1 | 3 | 50.0 | — | — | 146 | 3.8 |
| 21 | 1 | 4 | 5.0 | 2 | 3.0 | 13 | 6.9 |
| 22 | 1 | 4 | 15.0 | 2 | 3.0 | 44 | 7.0 |
| 23 | 1 | 4 | 25.0 | 2 | 3.0 | 69 | 7.1 |
| 24 | 1 | 4 | 50.0 | 2 | 3.0 | 140 | 7.2 |
| 25 | 2 | — | — | — | — | 11 | 4.0 |
| 26 | 3 | — | — | — | — | 53 | 4.1 |
| 27 | 4 | — | — | — | — | 95 | 4.2 |
| 28 | 5 | — | — | — | — | 214 | 4.1 |
| 29 | 6 | — | — | — | — | 489 | 4.0 |
| 30 | 2 | — | — | 2 | 3.0 | 12 | 5.9 |
| 31 | 3 | — | — | 2 | 3.0 | 58 | 5.8 |
| 32 | 4 | — | — | 2 | 3.0 | 112 | 5.9 |
| 33 | 5 | — | — | 2 | 3.0 | 203 | 5.7 |
| 34 | 6 | — | — | 2 | 3.0 | 498 | 5.9 |

Preparation of Rubber Mixture (CMB) for Domain Formation

Preparation of CMB1

First, the following materials were prepared.

100 parts of styrene butadiene rubber (trade name: Tufdene 1000, produced by Asahi Kasei Corporation) as a raw rubber 60 parts of carbon black (trade name: TOKABLACK #5500, produced by Tokai Carbon Co., Ltd.) as an electronic electro-conductive agent 5 parts of zinc oxide (trade name: 2 types of zinc oxide, produced by SAKAI CHEMICAL INDUSTRY CO., LTD.) as a vulcanization accelerator 2 parts of zinc stearate (trade name: SZ-2000, produced by SAKAI CHEMICAL INDUSTRY CO., LTD.) as a processing aid These materials were mixed with each other using a 6-liter pressure kneader (trade name: TD6-15MDX, manufactured by Toshinsha Co., Ltd.), thereby preparing CMB1. The mixing was performed under mixing conditions of a filling rate of 70 vol %, a blade rotation speed of 30 rpm, and a mixing time of 20 minutes.

In this case, an SP value and a Mooney viscosity of the raw rubber and a Mooney viscosity of CMB1 were measured by the above-described method. The results are shown in Table 2 together with each material composition of CMB1.

Details of abbreviations of the types of the raw rubbers shown in Table 2 are shown in Table 4, and details of abbreviations of the electro-conductive agents are shown in Table 5.

In addition, the term "parts by mass" in Table 2 refers to parts by mass of the electro-conductive agent with respect to 100 parts of the raw rubber.

Preparation of CMB2 to 9

CMB2 to 9 were prepared in the same manner as that of the preparation of CMB1, except that in the preparation of CMB1, the types of the raw rubber and the electro-conductive agent were changed as shown in Table 2.

In addition, similarly to CMB1, an SP value and a Mooney viscosity of the raw rubber of each of CMB2 to 9 and a Mooney viscosity of each of CMB2 to 9 were measured. The results are shown in Table 2 together with each material composition of each of CMB2 to 9.

TABLE 2

| CMB preparation example No. | Type of raw rubber: Abbreviation of material | | SP value/ $MPa^{0.5}$ | Mooney viscosity | Electro-conductive agent: Abbreviation of material | Parts by mass | DBP/ $cm^3/100$ g | Dispersion: time/ min | Mooney viscosity |
|---|---|---|---|---|---|---|---|---|---|
| 1 | SBR | T1000 | 16.8 | 45 | #5500 | 60 | 155 | 20 | 92 |
| 2 | SBR | T1000 | 16.8 | 45 | #5500 | 60 | 155 | 20 | 92 |
| 3 | SBR | T1000 | 16.8 | 45 | #5500 | 60 | 155 | 20 | 92 |
| 4 | NBR | DN401LL | 17.4 | 32 | #7360 | 70 | 87 | 20 | 90 |
| 5 | NBR | N220S | 20.4 | 57 | #7360 | 70 | 87 | 20 | 95 |
| 6 | EPDM | 505A | 16 | 47 | #5500 | 85 | 155 | 20 | 110 |

TABLE 2-continued

| CMB preparation example No. | Type of raw rubber: Abbreviation of material | | SP value/ $MPa^{0.5}$ | Mooney viscosity | Electro-conductive agent: Abbreviation of material | Parts by mass | DBP/ $cm^3/100$ g | Dispersion: time/ min | Mooney viscosity |
|---|---|---|---|---|---|---|---|---|---|
| 7 | BR | T0700 | 17.1 | 43 | #7360 | 85 | 87 | 20 | 100 |
| 8 | SBR | T2003 | 17 | 45 | — | — | — | — | 50 |
| 9 | ECO | CG102 | 18.5 | 52 | LV | 3 | — | 30 | 35 |

Preparation of Rubber Mixture (MRC) for Matrix Formation

Preparation of MRC1 First, the following materials were prepared.

- 100 parts of butyl rubber (trade name: JSR Butyl 065, produced by JSR CORPORATION) as a raw rubber
- 70 parts of calcium carbonate (trade name: Nanox #30, produced by MARUO CALCIUM CO., LTD.) as a filler
- 7 parts of zinc oxide (trade name: 2 types of zinc oxide, produced by SAKAI CHEMICAL INDUSTRY CO., LTD.) as a vulcanization accelerator
- 2.8 parts of zinc stearate (trade name: SZ-2000, produced by SAKAI CHEMICAL INDUSTRY CO., LTD.) as a processing aid These materials were mixed with each other using a 6-liter pressure kneader (trade name: TD6-15MDX, manufactured by Toshinsha Co., Ltd.), thereby preparing MRC1. The mixing was performed under mixing conditions of a filling rate of 70 vol %, a blade rotation speed of 30 rpm, and a mixing time of 16 minutes.

In this case, an SP value and a Mooney viscosity of the raw rubber and a Mooney viscosity of MRC1 were measured by the above-described method. The results are shown in Table 3 together with each material composition of MRC1.

In addition, the term "parts by mass" in Table 3 refers to parts by mass of the electro-conductive agent with respect to 100 parts of the raw rubber. In addition, details of abbreviations of the types of the raw rubbers shown in Table 3 are shown in Table 4, and details of abbreviations of the electro-conductive agents are shown in Table 5.

Preparation of MRC2 to 8

MRC2 to 8 were prepared in the same manner as that of the preparation of MRC1, except that in the preparation of MRC1, the types of the raw rubber and the electro-conductive agent were changed as shown in Table 3.

In addition, similarly to MRC1, an SP value and a Mooney viscosity of the raw rubber of each of MRC2 to 8 and a Mooney viscosity of each of MRC2 to 8 were measured. The results are shown in Table 3 together with each material composition of each of MRC2 to 8.

TABLE 3

| MRC No. | Raw rubber: Abbreviation of material | | SP value [$MPa^{0.5}$] | Mooney viscosity [ML] | Electro-conductive agent: Abbreviation of material | Parts by mass | DBP [$cm^3/100$ g] | Dispersion time [min] | Mooney viscosity [ML] |
|---|---|---|---|---|---|---|---|---|---|
| 1 | Butyl | Butyl 065 | 15.8 | 32 | — | — | — | 16 | 35 |
| 2 | Butyl | Butyl 065 | 15.8 | 32 | — | — | — | 16 | 35 |
| 3 | Butyl | Butyl 065 | 15.8 | 32 | — | — | — | 16 | 35 |
| 4 | EPDM | 301A | 16 | 44 | — | — | — | 16 | 51 |
| 5 | EPDM | 505A | 16 | 47 | — | — | — | 16 | 52 |
| 6 | SBR | 12003 | 17 | 55 | #7360 | 20 | 87 | 16 | 70 |
| 7 | EPDM | 505A | 16 | 47 | — | — | — | 16 | 53 |
| 8 | NBR | N230SV | 19.2 | 32 | #7360 | 60 | 87 | 16 | 74 |

TABLE 4

| Abbreviation of material | | Material name | Trade name | Manufacturer's name |
|---|---|---|---|---|
| Butyl | Butyl065 | Butyl rubber | JSR Butyl 065 | JSR CORPORATION |
| BR | T0700 | Polybutadiene rubber | JSR T0700 | JSR CORPORATION |
| EPDM | 301A | Ethylene propylene diene rubber | Esprene301A | Sumitomo Chemical Co., Ltd. |
| EPDM | 505A | Ethylene propylene diene rubber | Esprene505A | Sumitomo Chemical Co., Ltd. |
| NBR | N230SV | Acrylonitrile butadiene rubber | NBR N230SV | JSR CORPORATION |
| NBR | N220S | Acrylonitrile butadiene rubber | NBR N202S | JSR CORPORATION |
| NBR | DN401LL | Acrylonitrile butadiene rubber | Nipol DN401LL | Zeon Corporation |
| SBR | T2003 | Styrene butadiene rubber | Tufdene 2003 | Asahi Kasei Corporation |
| SBR | T1000 | Styrene butadiene rubber | Tufdene 1000 | Asahi Kasei Corporation |
| ECO | CG102 | Epichlorohydrin rubber | Epichlomer CG102 | OSAKA SODA CO., LTD. |

TABLE 5

| Abbreviation of material | Material name | Trade name | Manufacturer's name |
|---|---|---|---|
| #7360 | Electro-conductive carbon black | TOKABLACK #7360SB | Tokai Carbon Co., Ltd. |
| #5500 | Electro-conductive carbon black | TOKABLACK #5500 | Tokai Carbon Co., Ltd. |
| LV | Ion electro-conductive agent | LV70 | ADEKA |

Production of Charging Member

Production of Charging Roller 1

As a cylindrical support, a round rod having a surface that was formed of stainless steel (SUS304) and was subjected to electroless nickel plating, and having a total length of 252 mm and an outer diameter of 6 mm was prepared.

Next, 25 parts of CMB1 and 85 parts of MRC1 were mixed with each other using a 6-liter pressure kneader (trade name: TD6-15MDX, manufactured by Toshinsha Co., Ltd.). The mixing was performed under mixing conditions of a filling rate of 70 vol %, a blade rotation speed of 30 rpm, and a mixing time of 20 minutes.

Next, the following materials were prepared.

100 parts of a mixture of CMB1 and MRC1

3 parts of sulfur (trade name: SULFAX PMC, produced by Tsurumi Chemical Industry Co., Ltd.) as a vulcanizing agent 1 part of tetramethylthiuram disulfide (trade name: Nocceler TT-P, produced by OUCHI SHINKO CHEMICAL INDUSTRIAL CO., LTD.) as a vulcanization aid These materials were mixed with each other using an open roll having a roll diameter of 12 inches (0.30 m), thereby preparing an unvulcanized rubber mixture for electro-conductive layer formation. Cut-back at the left and right was performed about 20 times in total under mixing conditions of a front-roll rotation speed of 10 rpm, a back-roll rotation speed of 8 rpm, and a roll gap of 2 mm, and then tight milling was performed 10 times at a roll gap of 0.5 mm.

A die having an inner diameter of 10.0 mm was attached to a tip of a cross head extruder equipped with a mechanism for supplying the support and a mechanism for discharging an unvulcanized rubber roller, temperatures of the extruder and the cross head were set to 80° C., and a conveyance speed of the support was adjusted to 60 mm/sec. Under these conditions, the unvulcanized rubber mixture for electro-conductive layer formation was supplied from the extruder to cover an outer circumferential portion of the support with the unvulcanized rubber mixture for electro-conductive layer formation in the cross head, thereby obtaining an unvulcanized rubber roller.

Next, the unvulcanized rubber roller was put into a hot-air vulcanizing furnace at 160° C. to vulcanize the unvulcanized rubber mixture for electro-conductive layer formation by performing heating for 60 minutes, thereby obtaining a roller having an electro-conductive layer formed on the outer circumferential portion of the support. Thereafter, each of both ends of the electro-conductive layer was cut off by 10 mm to set a length of the electro-conductive layer in the longitudinal direction to 232 mm.

Finally, a surface of the electro-conductive layer was polished with a rotary grindstone. As a result, a crown-shaped charging roller 1 having diameters of 8.44 mm at positions corresponding to about 90 mm from the central portion to sides close to the both ends, respectively, and a diameter of 8.5 mm at the central portion was obtained.

A matrix-domain structure of the obtained charging roller 1 was confirmed as follows. In addition, in the charging roller 1, a volume resistivity $\rho_D$ [Sam] of the domain, a volume resistivity $\rho_M$ [Ω·cm] of the matrix, and an arithmetic mean value $D_{ms}$ [μm] of distances between wall surfaces of the domains were measured as follows. In addition, in the charging roller 1, uniformity of the volume resistivity of the domain and uniformity of the distances between the wall surfaces of the domains were evaluated by the above-described method, specifically, as follows.

Confirmation of Matrix-Domain Structure

A piece was cut out using a razor so that a cross section of the electro-conductive layer perpendicular to a longitudinal direction was observed, platinum vapor deposition was performed on the piece, and an image of the piece was captured with a scanning electron microscope (SEM) (trade name: S-4800, manufactured by Hitachi High-Technologies Corporation) at a magnification of 1,000, thereby obtaining a cross section image.

Subsequently, an arithmetic mean value K (number %) of binarized images obtained using image processing software (trade name: ImageProPlus, manufactured by Media Cybernetics, Inc.) was calculated by a counting function.

Arithmetic mean value K (number %): a ratio of isolated domains without being in contact with each other with respect to a total number of domains that are present in a region having a 50 μm square and do not have a contact point with a frame line of the binarized image In this case, as illustrated in FIG. 2, a domain group was confirmed, the domain group being in a state in which domains were dispersed in the matrix and present independently of each other without being in contact with each other, and the matrix was present in a continuous state in the image.

Subsequently, the presence or absence of the matrix-domain structure was determined as follows. That is, the measurement was performed by preparing the pieces obtained from 20 points in total, the 20 points being obtained from arbitrary one point of each of regions obtained by evenly dividing the electro-conductive layer into five in the longitudinal direction and evenly dividing the electro-conductive layer into four in the circumferential direction. When the obtained arithmetic mean value K (number %) was 80 or more, the matrix-domain structure was evaluated as "presence", and when the obtained arithmetic mean value K (number %) was less than 80, the matrix-domain structure was determined as "absence".

Measurement of Volume Resistivity $\rho_M$ of Matrix

In order to evaluate the volume resistivity $\rho_M$ of the matrix included in the electro-conductive layer, the following measurement was performed. A scanning probe microscope (SPM) (trade name: Q-Scope 250, manufactured by Quesant Instrument Corporation) was operated in a contact mode.

First, a thin piece having a thickness of 1 μm was cut out from an electro-conductive layer of an electro-conductive member A1 at a cutting temperature of −100° C. using a microtome (trade name: Leica EM FCS, manufactured by Leica Microsystems). As illustrated in FIG. 4, when a longitudinal direction of the electro-conductive member was set to an X-axis, a thickness direction of the electro-conductive layer was set to a Z-axis, and a circumferential direction of the electro-conductive layer was set to a Y-axis, a thin piece was cut out from the electro-conductive member so that at least a part of a YZ plane (for example, 83a, 83b, and 83c) perpendicular to an axial direction of the electro-conductive member was included in the thin piece.

In an environment of a temperature of 23° C. and a humidity of 50% RH, one surface of the thin piece (hereinafter, also referred to as a "grounded surface") was grounded on a metal plate, and a cantilever of a scanning probe microscope (SPM) (trade name: Q-Scope 250, manufactured by Quesant Instrument Corporation) was brought into contact with a portion corresponding to a surface of the matrix that is opposite to the grounded surface of the thin piece (hereinafter, also referred to as a "measurement surface") and having no domain between the measurement surface and the grounded surface. Subsequently, a voltage of 50 V was applied to the cantilever for 5 seconds to measure a current value, and an arithmetic mean value of the measured current values for 5 seconds was calculated.

A surface shape of the measurement piece was observed with the SPM, and a thickness of the measurement portion was calculated from the obtained height profile. In addition, a concave area of the contact portion with the cantilever was calculated from the observation result of the surface shape. A volume resistivity was calculated from the length and the concave area.

The measurement of the thin piece was performed by preparing pieces obtained from 20 points in total, the 20 points being obtained from arbitrary one point of each of regions obtained by evenly dividing the electro-conductive layer into five in the longitudinal direction and evenly dividing the electro-conductive layer into four in the circumferential direction. An average value thereof was defined as a volume resistivity $\rho_M$ of the matrix.

The scanning was performed with the SPM in a contact mode.

Measurement of Volume Resistivity $\rho_D$ of Domain $\rho_M$ was calculated in the same manner as that "Measurement of Volume Resistivity $\rho_M$ of Matrix", except that the portion of the measurement surface with which the cantilever was brought into contact was changed to a portion corresponding to the domain and having no matrix between the measurement surface and the grounded surface, and the applied voltage when measuring the current value was changed to 1 V.

Measurement of Arithmetic Mean Value $D_{ms}$ of Distances between Wall Surfaces of Domains The distance $D_{ms}$ between the wall surfaces of the domains observed on the outer surface of the charging member was quantified according to the above-described method.

The results are shown in Table 6 together with a configuration of Charging Roller Production Example 1.

Details of abbreviations of the vulcanizing agent and the vulcanization accelerator shown in Table 6 are shown in Table 7.

Production of Charging Rollers 2 to 9

Charging rollers 2 to 9 were produced in the same manner as that of the charging roller 1, except that in the production of the charging roller 1, the type of CMB, the type of MRC, a mixing ratio of CMB and MRC, the type of the vulcanizing agent, and the type of the vulcanization accelerator were changed as shown in Table 6. The mark "-" in the column showing the rubber mixture in Table 6 refers to that the corresponding rubber mixture is not used.

Production of Charging Roller 10

First, the following materials were prepared.

- 100 parts of epichlorohydrin rubber (EO-EP-AGE terpolymer) (trade name: EPICHLOMER CG102, produced by OSAKA SODA CO., LTD.) as a raw rubber
- 3 parts of LV-70 (trade name: Adekacizer LV70, produced by ADEKA Corporation) as an ion electro-conductive agent
- 10 parts of an aliphatic polyester-based plasticizer (trade name: Polycizer P-202, produced by DIC Corporation) as a plasticizer
- 60 parts of calcium carbonate (trade name: Nanox #30, produced by MARUO CALCIUM CO., LTD.) as a filler
- 5 parts of zinc oxide (trade name: 2 types of zinc oxide, produced by SAKAI CHEMICAL INDUSTRY CO., LTD.) as a vulcanization accelerator
- 1 part of zinc stearate (trade name: SZ-2000, produced by SAKAI CHEMICAL INDUSTRY CO., LTD.) as a processing aid These materials were mixed with each other using a 6-liter pressure kneader (trade name: TD6-15MDX, manufactured by Toshinsha Co., Ltd.), thereby preparing an unvulcanized hydrin rubber composition. The mixing was performed under mixing conditions of a filling rate of 70 vol %, a blade rotation speed of 30 rpm, and a mixing time of 20 minutes.

Next, the following materials were prepared.

- 100 parts of the unvulcanized hydrin rubber composition
- 1.8 parts of sulfur (trade name: SULFAX PMC, produced by Tsurumi Chemical Industry Co., Ltd.) as a vulcanizing agent
- 1 part of tetramethylthiuram monosulfide (trade name: Nocceler TS, produced by OUCHI SHINKO CHEMICAL INDUSTRIAL CO., LTD.) as a vulcanization aid 1
- 1 part of 2-mercaptobenzimidazole (trade name: NOCRAC MB, produced by OUCHI SHINKO CHEMICAL INDUSTRIAL CO., LTD.) as a vulcanization aid 2

These materials were mixed with each other using an open roll having a roll diameter of 12 inches, thereby preparing a first unvulcanized rubber composition. Cut-back at the left and right was performed about 20 times in total under mixing conditions of a front-roll rotation speed of 10 rpm, a back-roll rotation speed of 8 rpm, and a roll gap of 2 mm, and then tight milling was performed 10 times at a roll gap of 0.5 mm.

Next, an unvulcanized rubber mixture for electro-conductive layer formation used in the production of the charging roller 1 was prepared as a second unvulcanized rubber mixture.

Figure 6:
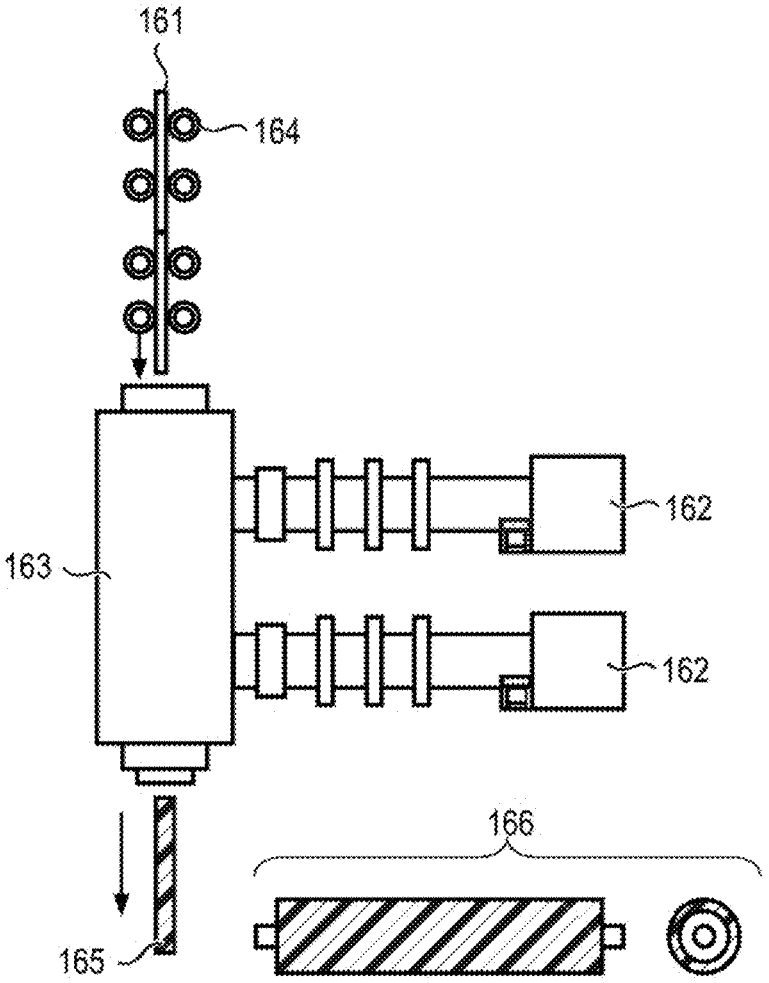
FIG. 6 is a schematic view of a double layer extrusion process.

In order to form the prepared first unvulcanized rubber composition and the prepared second unvulcanized rubber mixture on a periphery of a mandrel, a double layer extrusion was performed using a double layer extruder as illustrated in FIG. 6. FIG. 6 is a schematic view of a double layer extrusion process. An extruder 162 includes a double layer cross head 163. A charging member 166 obtained by stacking a second electro-conductive layer on a first electro-conductive layer by using two types of unvulcanized rubbers can be produced by the double layer cross head 163. A mandrel 161 fed by a core metal feeding roller 164 which rotates in the arrow direction is inserted into the double layer cross head 163 from a rear portion of the double layer cross head 163. By integrally extruding two types of cylindrical unvulcanized rubber layers together with the mandrel 161, an unvulcanized rubber roller 165 whose periphery is coated with the two types of the unvulcanized rubber layers is obtained. The obtained unvulcanized rubber roller 165 is unvulcanized using a hot-air circulation furnace or an infrared-ray drying furnace. Then, the charging member 166 can be obtained by removing the unvulcanized rubber on each of both ends of the electro-conductive layer.

The double layer cross head was adjusted so that a temperature was 100° C. and an outer diameter of an extrudate obtained after the extrusion was 10.0 mm. Next, a mandrel was prepared and extruded together with a raw rubber to simultaneously form two cylindrical raw rubber layers on the periphery of a core metal, thereby obtaining an unvulcanized rubber roller. Thereafter, the unvulcanized rubber roller was injected to a hot-air vulcanizing furnace of 160° C. and heated for 1 hour, thereby obtaining a double layer elastic roller including a hydrin group layer (first electro-conductive layer) formed on an outer circumference portion of the support and a surface layer (second electro-conductive layer) having a matrix-domain structure formed on an outer circumference portion of the hydrin group layer. A thickness ratio of the hydrin group layer to the surface layer or an outer diameter of the entire roller was adjusted so that a thickness of the surface layer was 0.5 mm. Thereafter, each of both ends of the electro-conductive layer was cut off by 10 mm to set a length of the electro-conductive layer in the longitudinal direction to 232 mm.

Finally, a surface of the electro-conductive layer was polished with a rotary grindstone. As a result, a crown-shaped charging roller 10 having diameters of 8.4 mm at positions corresponding to about 90 mm from the central portion to sides close to the both ends, respectively, and a diameter of 8.5 mm at the central portion was obtained.

A matrix-domain structure in each of the charging rollers 2 to 10 was confirmed in the same manner as that of the charging roller 1. In addition, a volume resistivity $\rho_D$ [Ω·cm] of the domain, a volume resistivity $\rho_M$ [Ω·cm] of the matrix, and an arithmetic mean value $D_{ms}$ [μm] of distances between wall surfaces of the domains were measured in the same manner as those of the charging roller 1. Furthermore, uniformity of the volume resistivity of the domain and uniformity of the distance between the wall surfaces of the domains were evaluated in the same manner as those of the charging roller 1.

The results are shown in Table 6.

TABLE 6

| Charging roller No. | Unvulcanized rubber composition: CMB No. | MRC No. | CMB parts by mass | MRC parts by mass | Mixing condition: Rotation speed [rpm] | Kneading time [min] | Vulcanizing agent: Abbreviation of material | Parts by mass | Vulcanization accelerator: Abbreviation of material | Parts by mass | Physical property value: Sea-island structure | $\rho_M$ [Ω · cm] | $\rho_M/\rho_D$ | $D_{ms}$ [μm] |
|---|---|---|---|---|---|---|---|---|---|---|---|---|---|---|
| 1 | 1 | 1 | 25 | 85 | 30 | 20 | Sulfur | 3 | TT | 3 | Presence | $7.1 \times 10^{16}$ | $2.8 \times 10^{15}$ | 0.21 |
| 2 | 2 | 2 | 24 | 80 | 30 | 20 | Sulfur | 3 | TT | 3 | Presence | $3.0 \times 10^{16}$ | $3.0 \times 10^{16}$ | 0.45 |
| 3 | 3 | 3 | 22.5 | 75 | 30 | 20 | Sulfur | 3 | TT | 3 | Presence | $6.6 \times 10^{16}$ | $8.7 \times 10^{15}$ | 1.15 |
| 4 | 4 | 4 | 25 | 78 | 30 | 20 | Sulfur | 3 | sTET | 3 | Presence | $6.4 \times 10^{15}$ | $1.3 \times 10^{15}$ | 1.92 |
| 5 | 5 | 5 | 25 | 75 | 30 | 20 | Sulfur | 3 | sTET | 3 | Presence | $6.3 \times 10^{15}$ | $1.1 \times 10^{14}$ | 5.6 |
| 6 | 6 | 6 | 25 | 75 | 30 | 20 | Sulfur | 3 | sTET | 3 | Presence | $7.3 \times 10^{5}$ | $1.9 \times 10^{7}$ | 0.21 |
| 7 | 7 | 7 | 25 | 75 | 30 | 16 | Sulfur | 3 | nTET | 3 | Presence | $9.3 \times 10^{15}$ | $1.1 \times 10^{14}$ | 18 |
| 8 | 8 | 8 | 75 | 25 | 30 | 20 | Sulfur | 3 | TBZTD | 1 | Presence | $9.2 \times 10^{2}$ | $3.6 \times 10^{13}$ | 2.2 |
| 9 | 9 | — | 100 | 0 | — | — | Sulfur | 3 | TBZTD | 1 | Absence | — | — | — |
| 10 | — | — | — | — | — | — | — | — | — | — | Absence | $8.7 \times 10^{15}$ | $1.4 \times 10^{14}$ | 0.22 |

TABLE 7

| Abbreviation of material | Material name | Trade name | Manufacturer's name |
|---|---|---|---|
| Sulfur | Sulfur | SULFAX PMC | Tsurumi Chemical Industry Co., Ltd. |
| 25B-40 | 2,5-Dimethyl-2,5-di(t-butylperoxy)hexyne | PERHEXA 25B-40 | NOF CORPORATION |
| TT | Tetramethylthiuram disulfide | Nocceler TT-P | OUCHI SHINKO CHEMICAL INDUSTRIAL CO., LTD. |
| sTET | Tetraethylthiuram disulfide | Sanceler TET-G | SANSHIN CHEMICAL INDUSTRY CO., LTD. |
| TBZTD | Tetrabenzylthiuram disulfide | Sanceler TBZTD | SANSHIN CHEMICAL INDUSTRY CO., LTD. |
| nTET | Tetraethylthiuram disulfide | Nocceler TET-G | OUCHI SHINKO CHEMICAL INDUSTRIAL CO., LTD. |

Production Example of Transfer Member

Production of Transfer Roller 1

First, the following materials were prepared.

70 parts of acrylonitrile butadiene rubber (trade name: Nipol DN401LL, produced by ZEON CORPORATION) as unvulcanized rubber 30 parts of an epichlorohydrin/ethylene oxide/ally glycidyl ether terpolymer (trade name: Epichlomer CG102, Daiso Co., Ltd.) of which a Mooney viscosity [ML] (1+4) 100° C. is 56 [ML]

40 parts of carbon black (trade name: ASAHI #35G, produced by ASAHI CARBON CO., LTD.) as an additive 3.0 parts of zinc stearate (produced by NOF CORPORATION) as a vulcanization aid 1.0 part of stearic acid (trade name: stearic acid tsubaki, produced by NOF CORPORATION) as a vulcanization aid These materials were kneaded at a rotor rotation speed of 30 rpm for 7 minutes with a 7 L closed type kneader (trade name: WDS7-30, manufactured by Moriyama Company Ltd.), thereby obtaining an unvulcanized rubber composition.

Next, the following materials were prepared.

- 0.5 parts of p,p'-oxybisbenzenesulfonyl hydrazide (OBSH) having a median diameter of 17 μm (trade name: NEOCELLBORN N #1000S, produced by Eiwa Chemical Ind. Co., Ltd.) as a foaming agent
- 2.5 parts of dibenzothiazyl disulfide (trade name: Nocceler DM-P, produced by OUCHI SHINKO CHEMICAL INDUSTRIAL CO., LTD.) as a vulcanization accelerator
- 2.0 parts of tetraethylthiuram disulfide (trade name: Nocceler TET-G, produced by OUCHI SHINKO CHEMICAL INDUSTRIAL CO., LTD.) as a vulcanization accelerator
- 3.0 parts of sulfur (trade name: SULFAX PMC, produced by Tsurumi Chemical Industry Co., Ltd.) as a vulcanizing agent These materials were added to the kneaded unvulcanized rubber composition, and the unvulcanized rubber composition was kneaded and dispersed for 15 minutes while cooling the unvulcanized rubber composition so that the temperature of the unvulcanized rubber composition was kept at 80° C. or lower using a 12-inch open roll (manufactured by KANSAI ROLL Co., Ltd.). Finally, the unvulcanized rubber composition was trimmed into a ribbon shape and then taken out, thereby preparing an unvulcanized rubber composition for an electro-conductive foam layer.

Figure 7:
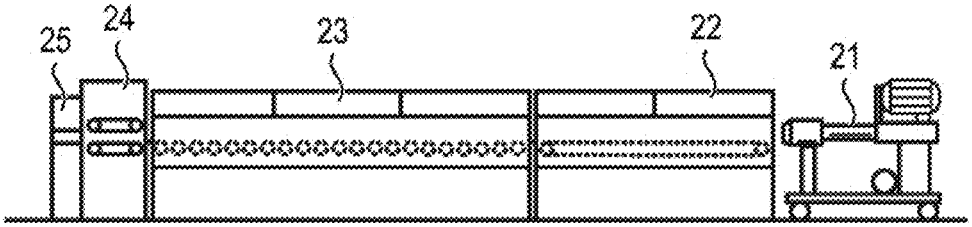
FIG. 7 is a schematic view of an apparatus used in production of a transfer roller in an example.

Subsequently, the ribbon-shaped unvulcanized rubber composition for an electro-conductive foam layer was extruded into a tube shape with a 60 mm vented rubber extruder 21 (manufactured by MITSUBA MFG. CO., LTD.) using a producing apparatus illustrated in FIG. 7. Next, the extrudate was vulcanized and foamed using a vulcanization apparatus (manufactured by Micro Denshi Co., Ltd.) including a 3.0 kW microwave vulcanization device 22, thereby producing a rubber tube. The microwave vulcanization device 22 was set as follows: a frequency was set to 2,450±50 MHz, an output was set to 0.6 kW, and an inner furnace temperature was set to 180° C. The rubber tube was vulcanized and foamed in the microwave vulcanization device 22, and then the rubber tube was further vulcanized and foamed using a hot-air vulcanization device 23 in which the inner furnace temperature was set to 200° C.

An outer diameter of the vulcanized and foamed tube was about 14.0 mm and an inner diameter of the vulcanized and foamed tube was about 4.0 mm. The rubber tube was conveyed at a rate of 2.0 m/min in the microwave vulcanization device and hot-air vulcanization device by a drawing machine 24. A length of the microwave vulcanization device 22 was about 4 m, a length of the hot-air vulcanization device 23 was about 6 m, and a length of the drawing machine 24 was about 1 m. That is, the time taken for passing through the microwave vulcanization device was about 2 minutes, the time taken for passing through the hot-air vulcanization device was about 3 minutes, and the time taken for passing through the drawing machine was about 30 seconds. After vulcanization and foaming, a standard length cutter 25 was used to cut the rubber tube in a length of 250 mm, a core metal 11 having an outer diameter of 5 mm was pressed against the rubber tube, and then both ends of the resultant were cut, thereby obtaining a roller having a rubber length of 216 mm. An outer circumferential surface of the roller was polished at a rotation speed of 1,800 RPM and a feeding speed of 800 mm/min so that an outer diameter was 12.5 mm, thereby producing a transfer roller 1.

Production of Transfer Rollers 2 to 5

Transfer rollers 2 to 5 were produced in the same manner as that of the transfer roller 1, except that in the production of the transfer roller 1, the median diameter and the used amount of the foaming agent were changed as shown in Table 8. Details of abbreviations of the vulcanizing agent and the vulcanization accelerator shown in Table 8 are shown in Table 9. OBSH was separated from the materials shown in Table 9 to adjust the median diameter.

An average cell diameter of each of the transfer rollers 1 to 5 was measured by the above-described method, specifically, as follows.

A surface observed image of the transfer roller was obtained using a digital microscope (trade name: VHX-5000, manufactured by Keyence Corporation) at a lens magnification of 100 and a measurement range of 2.7 mm×3.6 mm. A binarized image was obtained from the image using image processing software provided with the microscope. Next, a cell diameter in the binarized image was calculated, an average value of diameters of 20 cells having the largest cell diameter was calculated, and then the average value was defined as a cell diameter obtained from the image observed image. The processing was performed for each of three surface observed images, and then an average cell diameter $L_{tr}$ was quantified as an arithmetic mean value of measured values of the cell diameters.

The results are shown in Table 8.

TABLE 8

| Transfer roller No. | Unvulcanized rubber [parts by mass] NBR-DN | NBR-GECO | Vulcanizing agent Sulfur | Vulcanization aid Zinc stearate | Stearic acid | Vulcanization accelerator DM-P | nTET | Foaming agent OBSH (median diameter) 1.4 μm | 4.6 μm | 12.3 μm | 15.5 μm | 17 μm | Additive Carbon black | Average cell diameter [μm] |
|---|---|---|---|---|---|---|---|---|---|---|---|---|---|---|
| 1 | 70 | 30 | 3 | 3 | 1 | 1.5 | 2 | | | | | 2.5 | 40 | 150 |
| 2 | 70 | 30 | 3 | 3 | 1 | 1.5 | 2 | | | | | 1.5 | 40 | 222 |
| 3 | 70 | 30 | 3 | 3 | 1 | 1.5 | 2 | | 1.5 | 0.5 | | | 40 | 301 |
| 4 | 70 | 30 | 3 | 3 | 1 | 1.5 | 2 | | | | 0.5 | | 40 | 476 |
| 5 | 70 | 30 | 3 | 3 | 1 | 1.5 | 2 | 1.3 | | | | | 40 | 536 |

TABLE 9

| Abbreviation of material | | Material name | Trade name | Manufacturer's name |
|---|---|---|---|---|
| NBR-DN | | Acrylonitrile butadiene rubber | Nipol DN401LL | Zeon Corporation |
| GECO | | Epichlorohydrin/ethylene oxide/ally glycidyl ether terpolymer | Epichlomer CG102 | Daiso Co., Ltd. |
| Stearic acid | | Stearic acid | Stearic acid tsubaki | NOF CORPORATION |
| Zinc stearate | | Zinc stearate | Stearic acid | |
| OBSH | Median diameter 1.4 μm | p,p'-oxybisbenzenesulfonyl hydrazide | NEOCELLBORN N#1000M | Eiwa Chemical Ind. Co., Ltd. |
| | Median diameter 4.6 μm | | NEOCELLBORN N#1000M | |
| | Median diameter 12.3 μm | | NEOCELLBORN N#1000S | |
| | Median diameter 15.5 μm | | NEOCELLBORN N#1000S | |
| | Median diameter 17 μm | | NEOCELLBORN N#1000S | |
| DM-P | | Dibenzothiazyl disulfide | Nocceler DM-P | OUCHI SHINKO CHEMICAL INDUSTRIAL CO., LTD. |
| nTET | | Tetraethylthiuram disulfide | Nocceler TET-G | OUCHI SHINKO CHEMICAL INDUSTRIAL CO., LTD. |
| Sulfur | | Sulfur | SULFAX PMC | Tsurumi Chemical Industry Co., Ltd. |

Example 1

The photosensitive member 1 and the charging roller 1 were mounted in a process cartridge of a laser beam printer (trade name: HP LaserJet Pro M17) manufactured by The Hewlett-Packard Company. In addition, the transfer roller 1 was attached to a transfer portion of a main body of the laser beam printer, thereby preparing a process cartridge of Example 1.

Examples 2 to 76 and Comparative Examples 1 to 36

A process cartridge of each of Examples 2 to 76 and Comparative Examples 1 to 36 was prepared in the same manner as that of Example 1, except that in Example 1, the photosensitive member, the charging roller, and the transfer roller were changed as shown in Tables 10 to 12.

All of the calculated values of $S_{CP}$ [μm] and $V_{mk,max}$ [V] of the photosensitive member, the measured values of $\rho_M$ [Ω·cm] and $D_{ms}$ [μm] and the calculated value of $\rho_M/\rho_D$ of the charging roller, and the average cell diameter $L_{tr}$ of the transfer roller are shown in Tables 10 to 12.

TABLE 10

| Example | Photosensitive member No. | Scp [μm] | Vmax,mk [V] | Charging roller No. | $\rho_M$ [Ω · cm] | $\rho_M/\rho_D$ | $D_m$ [μm] | Tranfer roller No. | Ltr [μm] |
|---|---|---|---|---|---|---|---|---|---|
| 1 | 1 | 15 | 9.2 | 1 | $7.1 \times 10^{16}$ | $2.8 \times 10^{15}$ | 0.21 | 3 | 301 |
| 2 | 2 | 53 | 9.4 | 1 | $7.1 \times 10^{16}$ | $2.8 \times 10^{15}$ | 0.21 | 3 | 301 |
| 3 | 2 | 53 | 9.4 | 6 | $7.3 \times 10^{05}$ | $1.9 \times 10^{07}$ | 0.21 | 3 | 301 |
| 4 | 2 | 53 | 9.4 | 2 | $3.0 \times 10^{16}$ | $3.0 \times 10^{16}$ | 0.45 | 3 | 301 |
| 5 | 2 | 53 | 9.4 | 3 | $6.6 \times 10^{16}$ | $8.7 \times 10^{15}$ | 1.15 | 3 | 301 |
| 6 | 2 | 53 | 9.4 | 4 | $6.4 \times 10^{15}$ | $1.3 \times 10^{15}$ | 1.92 | 3 | 301 |
| 7 | 2 | 53 | 9.4 | 5 | $6.3 \times 10^{15}$ | $1.1 \times 10^{14}$ | 5.6 | 3 | 301 |
| 8 | 3 | 82 | 9.5 | 1 | $7.1 \times 10^{16}$ | $2.8 \times 10^{15}$ | 0.21 | 3 | 301 |
| 9 | 3 | 82 | 9.5 | 2 | $3.0 \times 10^{16}$ | $3.0 \times 10^{16}$ | 0.45 | 3 | 301 |
| 10 | 3 | 82 | 9.5 | 10 | $8.7 \times 10^{15}$ | $1.4 \times 10^{14}$ | 0.22 | 3 | 301 |
| 11 | 3 | 82 | 9.5 | 5 | $6.3 \times 10^{15}$ | $1.1 \times 10^{14}$ | 5.6 | 3 | 301 |
| 12 | 3 | 82 | 9.5 | 7 | $9.3 \times 10^{15}$ | $1.1 \times 10^{14}$ | 18 | 3 | 301 |
| 13 | 4 | 145 | 9.6 | 1 | $7.1 \times 10^{16}$ | $2.8 \times 10^{15}$ | 0.21 | 3 | 301 |
| 14 | 4 | 145 | 9.6 | 7 | $9.3 \times 10^{15}$ | $1.1 \times 10^{14}$ | 18 | 3 | 301 |

TABLE 10-continued

| Example | Photosensitive member No. | Scp [μm] | Vmax,mk [V] | Charging roller No. | $\rho_M$ [Ω · cm] | $\rho_M/\rho_D$ | $D_m$ [μm] | Tranfer roller No. | Ltr [μm] |
|---|---|---|---|---|---|---|---|---|---|
| 15 | 5 | 13 | 6.0 | 1 | $7.1 \times 10^{16}$ | $2.8 \times 10^{15}$ | 0.21 | 3 | 301 |
| 16 | 6 | 52 | 6.1 | 1 | $7.1 \times 10^{16}$ | $2.8 \times 10^{15}$ | 0.21 | 3 | 301 |
| 17 | 6 | 52 | 6.1 | 4 | $6.4 \times 10^{15}$ | $1.3 \times 10^{15}$ | 1.92 | 3 | 301 |
| 18 | 6 | 52 | 6.1 | 5 | $6.3 \times 10^{15}$ | $1.1 \times 10^{14}$ | 5.6 | 3 | 301 |
| 19 | 7 | 76 | 6.3 | 1 | $7.1 \times 10^{16}$ | $2.8 \times 10^{15}$ | 0.21 | 3 | 301 |
| 20 | 7 | 76 | 6.3 | 3 | $6.6 \times 10^{16}$ | $8.7 \times 10^{15}$ | 1.15 | 3 | 301 |
| 21 | 7 | 76 | 6.3 | 5 | $6.3 \times 10^{15}$ | $1.1 \times 10^{14}$ | 5.6 | 3 | 301 |
| 22 | 7 | 76 | 6.3 | 7 | $9.3 \times 10^{15}$ | $1.1 \times 10^{14}$ | 18 | 3 | 301 |
| 23 | 8 | 139 | 6.4 | 1 | $7.1 \times 10^{16}$ | $2.8 \times 10^{15}$ | 0.21 | 3 | 301 |
| 24 | 8 | 139 | 6.4 | 7 | $9.3 \times 10^{15}$ | $1.1 \times 10^{14}$ | 18 | 3 | 301 |
| 25 | 17 | 15 | 3.3 | 1 | $7.1 \times 10^{16}$ | $2.8 \times 10^{15}$ | 0.21 | 3 | 301 |
| 26 | 18 | 52 | 3.6 | 1 | $7.1 \times 10^{16}$ | $2.8 \times 10^{15}$ | 0.21 | 3 | 301 |
| 27 | 18 | 52 | 3.6 | 5 | $6.3 \times 10^{15}$ | $1.1 \times 10^{14}$ | 5.6 | 3 | 301 |
| 28 | 19 | 71 | 3.7 | 1 | $7.1 \times 10^{16}$ | $2.8 \times 10^{15}$ | 0.21 | 3 | 301 |
| 29 | 19 | 71 | 3.7 | 2 | $3.0 \times 10^{16}$ | $3.0 \times 10^{16}$ | 0.45 | 3 | 301 |
| 30 | 19 | 71 | 3.7 | 4 | $6.4 \times 10^{15}$ | $1.3 \times 10^{15}$ | 1.92 | 3 | 301 |
| 31 | 19 | 71 | 3.7 | 5 | $6.3 \times 10^{15}$ | $1.1 \times 10^{14}$ | 5.6 | 3 | 301 |
| 32 | 19 | 71 | 3.7 | 7 | $9.3 \times 10^{15}$ | $1.1 \times 10^{14}$ | 18 | 3 | 301 |
| 33 | 20 | 146 | 3.8 | 1 | $7.1 \times 10^{16}$ | $2.8 \times 10^{15}$ | 0.21 | 3 | 301 |
| 34 | 20 | 146 | 3.8 | 5 | $6.3 \times 10^{15}$ | $1.1 \times 10^{14}$ | 5.6 | 3 | 301 |
| 35 | 20 | 146 | 3.8 | 1 | $7.1 \times 10^{16}$ | $2.8 \times 10^{15}$ | 0.21 | 3 | 301 |
| 36 | 20 | 146 | 3.8 | 7 | $9.3 \times 10^{15}$ | $1.1 \times 10^{14}$ | 18 | 3 | 301 |
| 37 | 21 | 13 | 6.9 | 1 | $7.1 \times 10^{16}$ | $2.8 \times 10^{15}$ | 0.21 | 3 | 301 |
| 38 | 22 | 44 | 7.0 | 1 | $7.1 \times 10^{16}$ | $2.8 \times 10^{15}$ | 0.21 | 3 | 301 |
| 39 | 22 | 44 | 7.0 | 5 | $6.3 \times 10^{15}$ | $1.1 \times 10^{14}$ | 5.6 | 3 | 301 |
| 40 | 23 | 69 | 7.1 | 1 | $7.1 \times 10^{16}$ | $2.8 \times 10^{15}$ | 0.21 | 3 | 301 |

TABLE 11

| Example | Photosensitive member No. | Scp [μm] | Vmax,mk [V] | Charging roller No. | ρM [Ω · cm] | ρM/ρD | Dm [μm] | Transfer roller No. | Ltr [μm] |
|---|---|---|---|---|---|---|---|---|---|
| 41 | 23 | 69 | 7.1 | 2 | $3.0 \times 10^{16}$ | $3.0 \times 10^{16}$ | 0.45 | 3 | 301 |
| 42 | 23 | 69 | 7.1 | 4 | $6.4 \times 10^{15}$ | $1.3 \times 10^{15}$ | 1.92 | 3 | 301 |
| 43 | 23 | 69 | 7.1 | 5 | $6.3 \times 10^{15}$ | $1.1 \times 10^{14}$ | 5.6 | 3 | 301 |
| 44 | 23 | 69 | 7.1 | 7 | $9.3 \times 10^{15}$ | $1.1 \times 10^{14}$ | 18 | 3 | 301 |
| 45 | 24 | 140 | 7.2 | 1 | $7.1 \times 10^{16}$ | $2.8 \times 10^{15}$ | 0.21 | 3 | 301 |
| 46 | 24 | 140 | 7.2 | 5 | $6.3 \times 10^{15}$ | $1.1 \times 10^{14}$ | 5.6 | 3 | 301 |
| 47 | 24 | 140 | 7.2 | 1 | $7.1 \times 10^{16}$ | $2.8 \times 10^{15}$ | 0.21 | 3 | 301 |
| 48 | 24 | 140 | 7.2 | 7 | $9.3 \times 10^{15}$ | $1.1 \times 10^{14}$ | 18 | 3 | 301 |
| 49 | 25 | 11 | 4.0 | 1 | $7.1 \times 10^{16}$ | $2.8 \times 10^{15}$ | 0.21 | 3 | 301 |
| 50 | 26 | 53 | 4.1 | 1 | $7.1 \times 10^{16}$ | $2.8 \times 10^{15}$ | 0.21 | 3 | 301 |
| 51 | 26 | 53 | 4.1 | 4 | $6.4 \times 10^{15}$ | $1.3 \times 10^{15}$ | 1.92 | 3 | 301 |
| 52 | 26 | 53 | 4.1 | 5 | $6.3 \times 10^{15}$ | $1.1 \times 10^{14}$ | 5.6 | 3 | 301 |
| 53 | 27 | 95 | 4.2 | 1 | $7.1 \times 10^{16}$ | $2.8 \times 10^{15}$ | 0.21 | 3 | 301 |
| 54 | 27 | 95 | 4.2 | 4 | $6.4 \times 10^{15}$ | $1.3 \times 10^{15}$ | 1.92 | 3 | 301 |
| 55 | 27 | 95 | 4.2 | 5 | $6.3 \times 10^{15}$ | $1.1 \times 10^{14}$ | 5.6 | 3 | 301 |
| 56 | 28 | 214 | 4.1 | 1 | $7.1 \times 10^{16}$ | $2.8 \times 10^{15}$ | 0.21 | 3 | 301 |
| 57 | 28 | 214 | 4.1 | 4 | $6.4 \times 10^{15}$ | $1.3 \times 10^{15}$ | 1.92 | 3 | 301 |
| 58 | 28 | 214 | 4.1 | 5 | $6.3 \times 10^{15}$ | $1.1 \times 10^{14}$ | 5.6 | 3 | 301 |
| 59 | 29 | 489 | 4.0 | 1 | $7.1 \times 10^{16}$ | $2.8 \times 10^{15}$ | 0.21 | 3 | 301 |
| 60 | 29 | 489 | 4.0 | 5 | $6.3 \times 10^{15}$ | $1.1 \times 10^{14}$ | 5.6 | 3 | 301 |
| 61 | 30 | 12 | 5.9 | 1 | $7.1 \times 10^{16}$ | $2.8 \times 10^{15}$ | 0.21 | 3 | 301 |
| 62 | 31 | 58 | 5.8 | 1 | $7.1 \times 10^{16}$ | $2.8 \times 10^{15}$ | 0.21 | 3 | 301 |
| 63 | 31 | 58 | 5.8 | 4 | $6.4 \times 10^{15}$ | $1.3 \times 10^{15}$ | 1.92 | 3 | 301 |
| 64 | 31 | 58 | 5.8 | 5 | $6.3 \times 10^{15}$ | $1.1 \times 10^{14}$ | 5.6 | 3 | 301 |
| 65 | 32 | 112 | 5.9 | 1 | $7.1 \times 10^{16}$ | $2.8 \times 10^{15}$ | 0.21 | 3 | 301 |
| 66 | 32 | 112 | 5.9 | 4 | $6.4 \times 10^{15}$ | $1.3 \times 10^{15}$ | 1.92 | 3 | 301 |
| 67 | 32 | 112 | 5.9 | 5 | $6.3 \times 10^{15}$ | $1.1 \times 10^{14}$ | 5.6 | 3 | 301 |
| 68 | 33 | 203 | 5.7 | 1 | $7.1 \times 10^{16}$ | $2.8 \times 10^{15}$ | 0.21 | 3 | 301 |
| 69 | 33 | 203 | 5.7 | 5 | $6.3 \times 10^{15}$ | $1.1 \times 10^{14}$ | 5.6 | 3 | 301 |
| 70 | 34 | 498 | 5.9 | 1 | $7.1 \times 10^{16}$ | $2.8 \times 10^{15}$ | 0.21 | 3 | 301 |
| 71 | 34 | 498 | 5.9 | 2 | $3.0 \times 10^{16}$ | $3.0 \times 10^{16}$ | 0.45 | 3 | 301 |
| 72 | 34 | 498 | 5.9 | 5 | $6.3 \times 10^{15}$ | $1.1 \times 10^{14}$ | 5.6 | 3 | 301 |
| 73 | 3 | 82 | 9.5 | 1 | $7.1 \times 10^{16}$ | $2.8 \times 10^{15}$ | 0.21 | 1 | 150 |
| 74 | 3 | 82 | 9.5 | 1 | $7.1 \times 10^{16}$ | $2.8 \times 10^{15}$ | 0.21 | 2 | 222 |
| 75 | 3 | 82 | 9.5 | 1 | $7.1 \times 10^{16}$ | $2.8 \times 10^{15}$ | 0.21 | 4 | 476 |
| 76 | 3 | 82 | 9.5 | 1 | $7.1 \times 10^{16}$ | $2.8 \times 10^{15}$ | 0.21 | 5 | 536 |

TABLE 12

| Comparative example | Photosensitive member No. | Scp [μm] | Vmax,mk [V] | Charging roller No. | $\rho_M$ [Ω · cm] | $\rho_M/\rho_D$ | $D_m$ [μm] | Transfer roller No. | Ltr [μm] |
|---|---|---|---|---|---|---|---|---|---|
| 1 | 9 | 13 | 1.3 | 1 | $7.1\times 10^{16}$ | $2.8 \times 10^{15}$ | 0.21 | 3 | 301 |
| 2 | 9 | 13 | 1.3 | 5 | $6.3 \times 10^{15}$ | $1.1 \times 10^{14}$ | 5.6 | 3 | 301 |
| 3 | 10 | 46 | 1.5 | 1 | $7.1 \times 10^{16}$ | $2.8 \times 10^{15}$ | 0.21 | 3 | 301 |
| 4 | 10 | 46 | 1.5 | 5 | $6.3 \times 10^{15}$ | $1.1 \times 10^{14}$ | 5.6 | 3 | 301 |
| 5 | 10 | 46 | 1.5 | 7 | $9.3 \times 10^{15}$ | $1.1 \times 10^{14}$ | 18 | 3 | 301 |
| 6 | 11 | 72 | 1.6 | 1 | $7.1 \times 10^{16}$ | $2.8 \times 10^{13}$ | 0.21 | 3 | 301 |
| 7 | 11 | 72 | 1.6 | 2 | $3.0 \times 10^{16}$ | $3.0 \times 10^{16}$ | 0.45 | 3 | 301 |
| 8 | 11 | 72 | 1.6 | 5 | $6.3 \times 10^{13}$ | $1.1 \times 10^{14}$ | 5.6 | 3 | 301 |
| 9 | 11 | 72 | 1.6 | 7 | $9.3 \times 10^{13}$ | $1.1 \times 10^{14}$ | 18 | 3 | 301 |
| 10 | 12 | 140 | 1.7 | 1 | $7.1 \times 10^{16}$ | $2.8 \times 10^{13}$ | 0.21 | 3 | 301 |
| 11 | 12 | 140 | 1.7 | 5 | $6.3 \times 10^{13}$ | $1.1 \times 10^{14}$ | 5.6 | 3 | 301 |
| 12 | 12 | 140 | 1.7 | 7 | $9.3 \times 10^{13}$ | $1.1 \times 10^{14}$ | 18 | 3 | 301 |
| 13 | 13 | 13 | 1.2 | 1 | $7.1 \times 10^{16}$ | $2.8 \times 10^{13}$ | 0.21 | 3 | 301 |
| 14 | 13 | 13 | 1.2 | 5 | $6.3 \times 10^{15}$ | $1.1 \times 10^{14}$ | 5.6 | 3 | 301 |
| 15 | 14 | 45 | 1.2 | 1 | $7.1 \times 10^{16}$ | $2.8 \times 10^{13}$ | 0.21 | 3 | 301 |
| 16 | 14 | 45 | 1.2 | 3 | $6.6 \times 10^{16}$ | $8.7 \times 10^{13}$ | 1.15 | 3 | 301 |
| 17 | 14 | 45 | 1.2 | 5 | $6.3 \times 10^{13}$ | $1.1 \times 10^{14}$ | 5.6 | 3 | 301 |
| 18 | 14 | 45 | 1.2 | 7 | $9.3 \times 10^{13}$ | $1.1 \times 10^{14}$ | 18 | 3 | 301 |
| 19 | 15 | 73 | 1.4 | 1 | $7.1 \times 10^{16}$ | $2.8 \times 10^{13}$ | 0.21 | 3 | 301 |
| 20 | 15 | 73 | 1.4 | 2 | $3.0 \times 10^{16}$ | $3.0 \times 10^{16}$ | 0.45 | 3 | 301 |
| 21 | 15 | 73 | 1.4 | 5 | $6.3 \times 10^{13}$ | $1.1 \times 10^{14}$ | 5.6 | 3 | 301 |
| 22 | 15 | 73 | 1.4 | 7 | $9.3 \times 10^{13}$ | $1.1 \times 10^{14}$ | 18 | 3 | 301 |
| 23 | 16 | 148 | 1.5 | 1 | $7.1 \times 10^{16}$ | $2.8 \times 10^{13}$ | 0.21 | 3 | 301 |
| 24 | 16 | 148 | 1.5 | 4 | $6.4 \times 10^{13}$ | $1.3 \times 10^{13}$ | 1.92 | 3 | 301 |
| 25 | 16 | 148 | 1.5 | 5 | $6.3 \times 10^{13}$ | $1.1 \times 10^{14}$ | 5.6 | 3 | 301 |
| 26 | 16 | 148 | 1.5 | 7 | $9.3 \times 10^{13}$ | $1.1 \times 10^{14}$ | 18 | 3 | 301 |
| 27 | 1 | 15 | 9.2 | 5 | $6.3 \times 10^{13}$ | $1.1 \times 10^{14}$ | 5.6 | 3 | 301 |
| 28 | 2 | 53 | 9.4 | 7 | $9.3 \times 10^{13}$ | $1.1 \times 10^{14}$ | 18 | 3 | 301 |
| 29 | 3 | 82 | 9.5 | 8 | $9.2 \times 10^{2}$ | $3.6 \times 10^{-13}$ | 2.2 | 3 | 301 |
| 30 | 3 | 82 | 9.5 | 9 | — | — | — | 3 | 301 |
| 31 | 5 | 13 | 6.0 | 5 | $6.3 \times 10^{13}$ | $1.1 \times 10^{14}$ | 5.6 | 3 | 301 |
| 32 | 6 | 52 | 6.1 | 7 | $9.3 \times 10^{13}$ | $1.1 \times 10^{14}$ | 18 | 3 | 301 |
| 33 | 17 | 15 | 3.3 | 5 | $6.3 \times 10^{13}$ | $1.1 \times 10^{14}$ | 5.6 | 3 | 301 |
| 34 | 21 | 13 | 6.9 | 5 | $6.3 \times 10^{13}$ | $1.1 \times 10^{14}$ | 5.6 | 3 | 301 |
| 35 | 25 | 11 | 4.0 | 5 | $6.3 \times 10^{13}$ | $1.1 \times 10^{14}$ | 5.6 | 3 | 301 |
| 36 | 30 | 12 | 5.9 | 5 | $6.3 \times 10^{13}$ | $1.1 \times 10^{14}$ | 5.6 | 3 | 301 |

Evaluation

The process cartridge of each of the examples and the comparative examples was evaluated as follows.

Apparatus for Evaluation

As an electrophotographic apparatus for evaluation, a monochrome direct transfer type printer was used. A laser beam printer (trade name: HP LaserJet Pro M17) manufactured by The Hewlett-Packard Company was prepared and modified so that the voltage applied to the charging roller, the voltage applied to the transfer roller, and the amount of image exposure were adjusted, and the control of the transfer bias was disabled in a paper intermediate portion. In addition, a high voltage power supply (Model 615-3, manufactured by Trek Japan) was connected to the transfer roller to modify the laser beam printer so that a voltage was applied to the transfer roller from the outside of the LBP.

In addition, the process cartridge of each of the examples and the comparative examples was attached to a process cartridge station.

Transfer Black Spot

The voltage applied to the charging roller and the amount of image exposure to the photosensitive member were set so that a dark part potential was −380 V and a bright part potential was −80 V. In the measurement of the potential on the surface of the photosensitive member when setting the potential, a process cartridge having a developing position in which a potential probe (trade name: model 6000B-8, manufactured by Trek Japan) was mounted was used. In addition, the potential of the surface of the photosensitive member was measured using a surface potential gauge (trade name: model344, manufactured by Trek Japan). In addition, the applied voltage of the transfer roller during the image formation was set to +3,000 V using an external power supply.

Figure 8A:
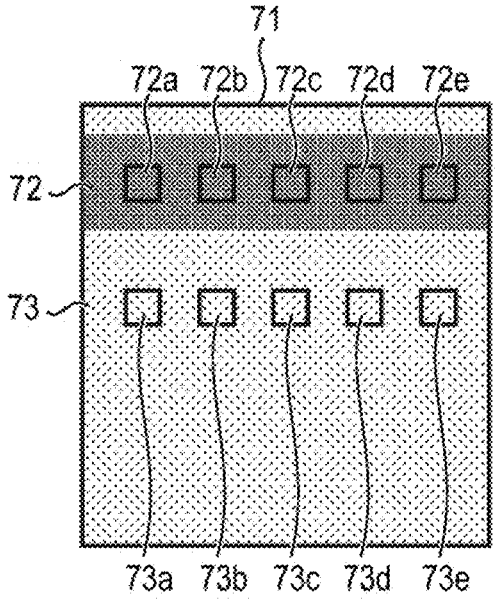
FIG. 8A is a schematic view of an output image for evaluation of a transfer black spot.

Next, two 1 dot-4 space halftone images were continuously output on an A4 size plain paper. When the first image was transferred, the paper was present between the photosensitive member and the transfer roller, but an interval of between the output of the first image and the output of the second image, the photosensitive member and the transfer roller were in direct contact with each other. Therefore, when a leading end of the second image was transferred, a black spot was generated at a portion affected by memory caused at a portion at which the photosensitive member and the transfer roller were in direct contact with each other. FIG. 8A illustrates a schematic view of the output image of the transfer black spot obtained by the above-described method.

Figure 8B:
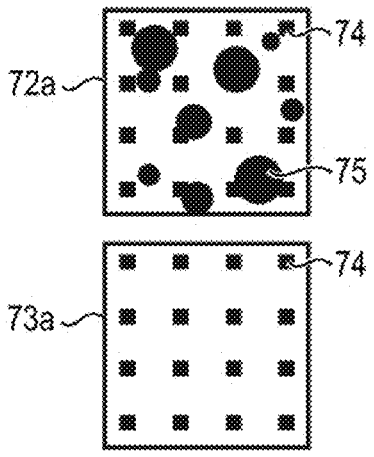
FIG. 8B illustrates partially enlarged views of a transferring without paper corresponding portion and a transferring with paper corresponding portion of an image for evaluation of a transfer black spot.

In addition, FIG. 8B illustrates a schematic view of the image output on an A4 size plain paper 71 obtained by enlarging a part 72*a* of a transferring without paper corresponding portion 72 which is a region in contact with the portion at which the photosensitive member and the transfer roller are in direct contact with each other. In addition, FIG. 8B also illustrates a schematic view of the image output on the A4 size plain paper 71 obtained by enlarging a part 73*a* of a transferring with paper corresponding portion 73 which is a region in contact with the portion at which the photosensitive member and the transfer roller are not into contact with each other. As illustrated in the partially enlarged view

72*a* of the transferring without paper corresponding portion 72, in the transferring without paper corresponding portion 72, a transfer black spot 75 caused by the foam cell of the transfer roller was present while being superposed on a 1 dot portion 74 of the 1 dot-4 space halftone image. On the other hand, as illustrated in the partially enlarged view 73*a* of the transferring with paper corresponding portion 73, in the transferring with paper corresponding portion 73, only the 1 dot portion 74 of the 1 dot-4 space halftone image was present without the presence of the transfer black spot.

Figure 9A:
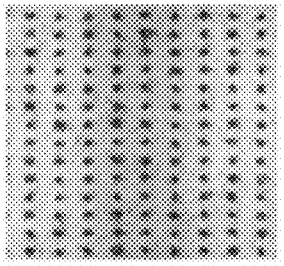
FIG. 9A is an image of a partial region of a transferring without paper corresponding portion obtained using a process cartridge of Example 8.
Figure 9B:
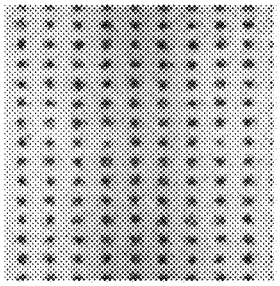
FIG. 9B is an image of a partial region of a transferring with paper corresponding portion obtained using the process cartridge of Example 8.
Figure 10A:
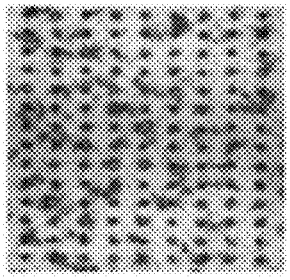
FIG. 10A is an image of a partial region of a transferring without paper corresponding portion obtained using a process cartridge of Comparative Example 6.
Figure 10B:
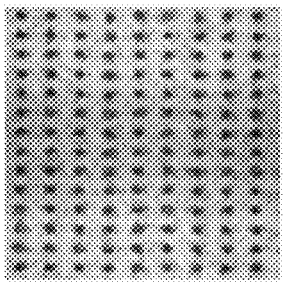
FIG. 10B is an image of a partial region of a transferring with paper corresponding portion obtained using the process cartridge of Comparative Example 6.

The transferring without paper corresponding portion 72 was evenly divided into five in a short side direction of the A4 size plain paper, and images of five 2,980 μm×2,980 μm partial regions (72*a*, 72*b*, 72*c*, 72*d*, and 72*e*) of the transferring without paper corresponding portion 72 were obtained at the center of a long side direction of the A4 size plain paper. The images were obtained using a hybrid laser microscope (trade name: OPTELICS, manufactured by Lasertec Corporation). FIG. 9A is the image of the partial region of the transferring without paper corresponding portion obtained using the process cartridge of Example 8. In addition, FIG. 10A is the image of the partial region of the transferring without paper corresponding portion obtained using the process cartridge of Comparative Example 6. Meanwhile, the transferring with paper corresponding portion was also divided into five in the short side direction of the A4 size plain paper, and images of 2,980 μm×2,980 μm partial regions 73*a*, 73*b*, 73*c*, 73*d*, and 73*e* of the transferring with paper corresponding portion were obtained. The images were obtained using a hybrid laser microscope (trade name: OPTELICS, manufactured by Lasertec Corporation). FIG. 9B is the image of the partial region of the transferring with paper corresponding portion obtained using the process cartridge of Example 8. In addition, FIG. 10B is the image of the partial region of the transferring with paper corresponding portion obtained using the process cartridge of Comparative Example 6.

Subsequently, the obtained 10 images were digitized in 256 gradations of black and white. In the three-dimensional numerical data, when one position coordinate (x,y) in a horizontal direction of the image is specified, a white and black density data value G corresponding thereto is determined. The coordinate in the horizontal direction was a square lattice, and its discrete scale was 2.91 μm.

The three-dimensional numerical data (x,y,G) was subjected to the same treatment as in the method of calculating "Dependency of Average Local Elevation Difference (Rmk [μm]) on Calculated Length (L [μm]) described in Japanese Patent Application Laid-Open No. 2013-117624, thereby obtaining dependency of an average local density difference ($G_{mk}$ [V]) on a calculated length S [μm]. In Japanese Patent Application Laid-Open No. 2013-117624, the surface roughness having a length dimension was analyzed and the average local elevation difference Rmk was calculated. The present exemplary embodiment is different from Japanese Patent Application Laid-Open No. 2013-117624 in that dimensionless white and black density 256 gradations were analyzed and the average local density difference $G_{mk}$ was calculated.

Figure 9C:
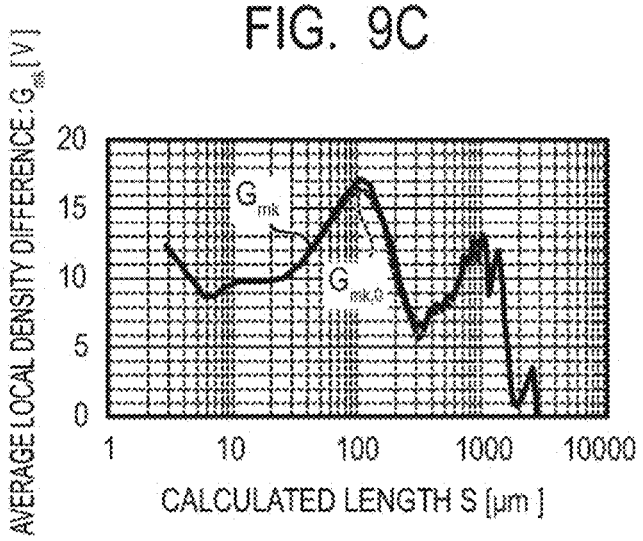
FIG. 9C is a graph showing dependency of an average local density difference $G_{mk}$ on a calculated length T obtained using the process cartridge of Example 8.
Figure 10C:
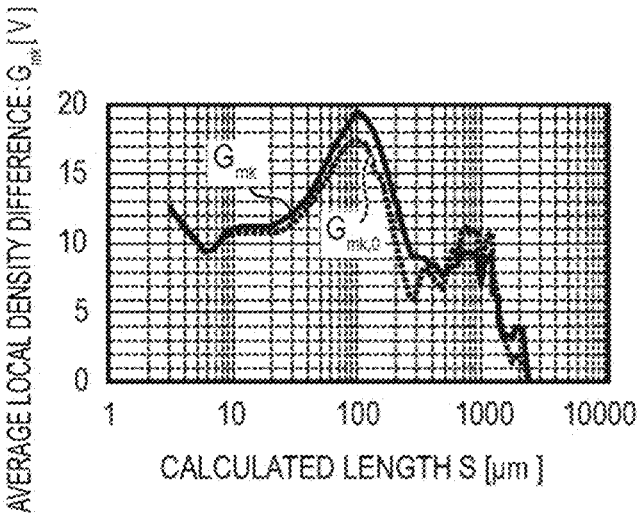
FIG. 10C is a graph showing dependency of an average local density difference $G_{mk}$ on a calculated length T obtained using the process cartridge of Comparative Example 6.

An arithmetic mean of the dependency of the average local density difference on the calculated length in the five partial regions of the transferring without paper corresponding portion is defined as $\langle G_{mk}\rangle$ (S), and an arithmetic mean of the dependency of the average local density difference on the calculated length in the five partial regions of the transferring with paper corresponding portion is defined as $\langle G_{mk,0}\rangle$ (S). FIG. 9C is a graph showing $\langle G_{mk}\rangle$ (S) and $\langle G_{mk,0}\rangle$ (S) obtained using the process cartridge of Example 8. In addition, FIG. 10C is a graph showing $\langle G_{mk}\rangle$ (S) and $\langle G_{mk,0}\rangle$ (S) obtained using the process cartridge of Comparative Example 6. In FIG. 9C and FIG. 10C, the solid line represents $\langle G_{mk}\rangle$ (S) and the broken line represents $\langle G_{mk,0}\rangle$ (S).

Finally, $h_G$ was calculated by the following Equation (E5) by using a VTF curve VTF(L) showing human visible sensitivity represented by $\langle G_{mk}\rangle$ (S), $\langle G_{mk,0}\rangle$ (S), and Equation E(1).

$$h_G = \int_{S_{min}}^{S_{max}} [\langle G_{mk}\rangle(S) - \langle G_{mk,0}\rangle(S)]\, VTF(T)\, d(InS) / \int_{S_{min}}^{S_{max}} VTF(S)\, d(InS) \quad \text{(E5)}$$

(wherein, each of Smin and Smax is a cutoff length.)

Since a scale on the $\langle G_{mk}\rangle$ (S) graph of the transfer black spot to be focused on in the present exemplary embodiment was about 300 μm, Smin was set to 45 μm and Smax was set to 1,000 μm. It is considered that the value hG is quantified at a visible degree of the transfer black spot when viewed with eyes of a human because the value hG is obtained by subtracting a value corresponding to the transferring with paper corresponding portion based on a value corresponding to the transferring without paper corresponding portion, and taking consideration of human visible sensitivity.

In addition, the transfer black spot on the output image was visualized, and the transfer black spot was evaluated based on the following criteria.

Rank A: The transfer black spot is absent.

Rank B: The transfer black spot is present but is not noticeable.

Rank C: The transfer black spot is present and noticeable.

Rank D: A large number of transfer black spots are present and formed in a black band shape.

The results are shown in Tables 13 and 14.

TABLE 13

| Example | $h_G$ | Transfer black spot visual rank |
|---|---|---|
| 1 | 0.65 | A |
| 2 | 0.58 | A |
| 3 | 0.73 | B |
| 4 | 0.6 | A |
| 5 | 0.66 | A |
| 6 | 0.65 | A |
| 7 | 0.91 | B |
| 8 | 0.67 | A |
| 9 | 0.66 | A |
| 10 | 0.67 | A |
| 11 | 0.72 | B |
| 12 | 1.01 | B |
| 13 | 0.74 | B |
| 14 | 1.2 | B |
| 15 | 0.71 | B |
| 16 | 0.64 | A |
| 17 | 0.74 | B |
| 18 | 1.03 | B |
| 19 | 0.75 | B |
| 20 | 0.65 | A |
| 21 | 0.82 | B |
| 22 | 1.22 | B |
| 23 | 0.81 | A |
| 24 | 1.34 | B |
| 25 | 0.82 | B |
| 26 | 0.64 | A |
| 27 | 1.21 | B |
| 28 | 0.72 | B |
| 29 | 0.63 | A |
| 30 | 0.73 | B |
| 31 | 0.85 | B |
| 32 | 0.93 | B |
| 33 | 0.91 | B |
| 34 | 0.95 | B |

TABLE 13-continued

| Example | $h_G$ | Transfer black spot visual rank |
|---|---|---|
| 35 | 0.97 | B |
| 36 | 1.34 | B |
| 37 | 0.91 | B |
| 38 | 0.64 | A |
| 39 | 0.92 | B |
| 40 | 0.73 | B |
| 41 | 0.63 | A |
| 42 | 0.76 | B |
| 43 | 0.8 | B |
| 44 | 1.03 | B |
| 45 | 0.89 | B |
| 46 | 0.92 | B |
| 47 | 0.9 | B |
| 48 | 1.33 | B |
| 49 | 0.7 | A |
| 50 | 0.65 | A |
| 51 | 0.72 | B |
| 52 | 1.06 | B |
| 53 | 0.75 | B |
| 54 | 0.64 | A |
| 55 | 0.83 | B |
| 56 | 0.86 | B |
| 57 | 0.69 | A |
| 58 | 0.96 | B |
| 59 | 0.87 | B |
| 60 | 0.95 | B |
| 61 | 0.74 | B |
| 62 | 0.67 | A |
| 63 | 0.85 | B |
| 64 | 1.19 | B |
| 65 | 0.72 | B |
| 66 | 0.64 | A |
| 67 | 0.83 | B |
| 68 | 0.85 | B |
| 69 | 0.94 | B |
| 70 | 0.86 | B |
| 71 | 0.83 | B |
| 72 | 0.93 | B |
| 73 | 0.71 | B |
| 74 | 0.63 | A |
| 75 | 0.65 | A |
| 76 | 0.76 | B |

TABLE 14

| Comparative example | $h_G$ | Transfer black spot visual rank |
|---|---|---|
| 1 | 2.28 | D |
| 2 | 3.08 | D |
| 3 | 2.15 | C |
| 4 | 2.89 | D |
| 5 | 3.14 | D |
| 6 | 2.36 | D |
| 7 | 2.18 | C |
| 8 | 2.51 | D |
| 9 | 3.19 | D |
| 10 | 2.68 | D |
| 11 | 2.93 | D |
| 12 | 3.09 | D |
| 13 | 2.33 | D |
| 14 | 3.11 | D |
| 15 | 2.21 | C |
| 16 | 2.34 | D |
| 17 | 2.85 | D |
| 18 | 2.45 | D |
| 19 | 2.33 | D |
| 20 | 2.21 | C |
| 21 | 2.47 | D |
| 22 | 3.13 | D |
| 23 | 2.65 | D |
| 24 | 2.46 | D |
| 25 | 2.84 | D |
| 26 | 3.83 | D |

TABLE 14-continued

| Comparative example | $h_G$ | Transfer black spot visual rank |
|---|---|---|
| 27 | 2.79 | D |
| 28 | 2.81 | D |
| 29 | 2.23 | C |
| 30 | 3.82 | D |
| 31 | 3.24 | D |
| 32 | 3.15 | D |
| 33 | 3.38 | D |
| 34 | 3.61 | D |
| 35 | 3.21 | D |
| 36 | 3.13 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191564, filed Oct. 18, 2019, which is hereby incorporated by reference herein in its entirety.

What is claimed is:

1. A process cartridge detachably attachable to a main body of an electrophotographic apparatus, the process cartridge comprising: an electrophotographic photosensitive member and a charging member, wherein the electrophotographic photosensitive member includes a support and a photosensitive layer, when average local potential differences of respective calculated lengths, the calculated lengths each are obtained by defining n as respective integers from 1 to 5,000, are determined based on the following calculation method by using a value obtained by charging an outer surface of the electrophotographic photosensitive member with −500 V, assuming that a straight line having a length of 5,000 μm is placed at an arbitrary position on the charged outer surface, and measuring potentials at measurement points located on the straight line at a pitch of 1 μm, a maximum value of the average local potential differences is 2 V or more, the charging member includes a support and an electro-conductive layer, the electro-conductive layer has a matrix and domains dispersed in the matrix, at least some domains are exposed to an outer surface of the charging member, the matrix contains a first rubber, the domain contains a second rubber and an electronic electro-conductive agent, a volume resistivity ρM of the matrix is at least $1.00\times10^5$ times a volume resistivity ρD of the domain, and when a calculated length in which a maximum value of the average local potential difference is obtained in the electrophotographic photosensitive member is defined as $S_{CP}$ [μm] and an arithmetic mean value of distances between wall surfaces of the domains observed on the outer surface of the charging member is defined as $D_{ms}$ [μm], $S_{CP}\geq3\times D_{ms}$, the calculation method comprising:

i) dividing the straight line into calculated length n×1 μm (where, n is an integer of 1 or more) to obtain 5,000/n [number] regions;

ii) calculating an average value of potentials, the potentials being obtained at all measurement points included in each region;

iii) calculating a difference between regions adjacent to each other with respect to the average value of the potentials at each region calculated in ii) (local potential difference); and iv) calculating an average value of the local potential differences (average local potential difference) obtained between the regions.

2. The process cartridge according to claim 1, wherein $S_{CP} \geq 10 \times D_{ms}$.

3. The process cartridge according to claim 1, wherein the maximum value of the average local potential difference is 8 V or more.

4. The process cartridge according to claim 1, wherein $S_{CP}$ is in a range of 10 μm to 100 μm.

5. The process cartridge according to claim 1, wherein $D_{ms}$ is 0.2 μm or more and 5.0 μm or less.

6. The process cartridge according to claim 1, wherein the volume resistivity of the matrix is more than $1.0 \times 10^{12}$ Ω·cm.

7. An electrophotographic apparatus comprising: an electrophotographic photosensitive member and a charging member, wherein the electrophotographic photosensitive member includes a support and a photosensitive layer, when average local potential differences of respective calculated lengths, the calculated lengths each are obtained by defining n as respective integers from 1 to 5,000, are determined based on the following calculation method by using a value obtained by charging an outer surface of the electrophotographic photosensitive member with −500 V, assuming that a straight line having a length of 5,000 μm is placed at an arbitrary position on the charged outer surface, and measuring potentials at measurement points located on the straight line at a pitch of 1 μm, a maximum value of the average local potential differences is 2 V or more, the charging member includes a support and an electro-conductive layer, the electro-conductive layer has a matrix and domains dispersed in the matrix, at least some domains are exposed to an outer surface of the charging member, the matrix contains a first rubber, the domain contains a second rubber and an electronic electro-conductive agent, a volume resistivity ρM of the matrix is at least $1.00 \times 10^5$ times a volume resistivity ρD of the domain, and when a calculated length in which a maximum value of the average local potential difference is obtained is defined as $S_{CP}$ [μm] and an arithmetic mean value of distances between wall surfaces of the domains observed on an outer surface of the electro-conductive layer is defined as $D_{ms}$ [μm], $S_{CP} \geq 3 \times D_{ms}$, the calculation method comprising:

i) dividing the straight line into calculated length n×1 μm (where, n is an integer of 1 or more) to obtain 5,000/n [number] regions;

ii) calculating an average value of potentials, the potentials being obtained at all measurement points included in each region;

iii) calculating a difference between regions adjacent to each other with respect to the average value of the potentials at each region calculated in ii) (local potential difference); and iv) calculating an average value of the local potential differences (average local potential difference) obtained between the regions.

8. The electrophotographic apparatus according to claim 7, further comprising a transfer unit, wherein the transfer unit includes a support and a transfer member having an electro-conductive foam layer.

9. The electrophotographic apparatus according to claim 8, wherein an average cell diameter $L_{tr}$ [μm] of foam cells in the electro-conductive foam layer observed on an outer surface of the transfer member is 3 times or more of $S_{CP}$ [μm].

10. The electrophotographic apparatus according to claim 9, wherein $L_{tr}$ is 200 μm or more and 500 μm or less.

11. The electrophotographic apparatus according to claim 9, wherein $L_{tr}$, $S_{CP}$, and $D_{ms}$ satisfy a relationship of $3 \times (D_{ms} \cdot L_{tr})^{0.5} \leq S_{CP} \leq 7 \times (D_{ms} \cdot L_{tr})^{0.5}$.

* * * * *